US010255747B2

(12) United States Patent
Iwako

(10) Patent No.: US 10,255,747 B2
(45) Date of Patent: Apr. 9, 2019

(54) PRODUCT DISCHARGE DEVICE FOR VENDING MACHINE

(71) Applicant: FUJI ELECTRIC CO., LTD., Kawasaki-shi, Kanagawa (JP)

(72) Inventor: Tsutomu Iwako, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/366,506

(22) Filed: Dec. 1, 2016

(65) Prior Publication Data

US 2017/0161982 A1 Jun. 8, 2017

(30) Foreign Application Priority Data

Dec. 3, 2015 (JP) ..... 2015-236895

(51) Int. Cl.
*G07F 11/04* (2006.01)
*G07F 11/24* (2006.01)

(52) U.S. Cl.
CPC ..... *G07F 11/04* (2013.01); *G07F 11/24* (2013.01)

(58) Field of Classification Search
CPC ..... G07F 11/04; G07F 11/06; G07F 11/24; G07F 11/42; G07F 11/005
See application file for complete search history.

(56) References Cited

U.S. PATENT DOCUMENTS 4,423,828 A * 1/1984 Tanaka ..... G07F 11/10 221/129
4,621,745 A * 11/1986 Grace ..... B65G 1/08 193/40
4,854,477 A * 8/1989 Kurosawa ..... G07F 11/10 221/1
5,111,963 A * 5/1992 Grace, Sr. ..... B65G 1/08 193/27
5,236,104 A * 8/1993 Stingel, Jr. ..... G07F 11/34 193/27
5,285,928 A * 2/1994 Stingel, Jr. ..... G07F 11/34 193/27

(Continued)

FOREIGN PATENT DOCUMENTS

JP 3198813 B2 8/2001

*Primary Examiner* — Gene O Crawford
*Assistant Examiner* — Kelvin L Randall, Jr.
(74) *Attorney, Agent, or Firm* — Manabu Kanesaka

(57) ABSTRACT

A product carry-out device of an automatic dispenser includes two sets of first stopper members and second stopper members corresponding to half-size products accommodated in two rows, a single driving device for driving the two sets of first stopper members and second stopper members, a link mechanism having link members corresponding to the first stopper members and second stopper members, a connection mechanism for connecting the single driving device and the link mechanism, and a switching device selectively connecting the connection mechanism and the link mechanism. The two sets of first stopper members and second stopper members are driven synchronously by connecting the connection mechanism and the link members. The connection mechanism and the one or another of the link members are separated from each other, thereby individually driving one or another of the two sets of first stopper members and second stopper members.

4 Claims, 16 Drawing Sheets

(56) References Cited

U.S. PATENT DOCUMENTS

| | | | | |
|---|---|---|---|---|
| 5,445,296 | A * | 8/1995 | Insausti | B65G 59/062 221/298 |
| 5,511,690 | A * | 4/1996 | Calhoun | B65G 59/062 221/197 |
| 5,779,094 | A * | 7/1998 | Stingel, Jr. | B65G 1/08 221/2 |
| 6,467,648 | B1 * | 10/2002 | Nishiyama | G07F 11/06 221/289 |
| 7,128,239 | B2 * | 10/2006 | Skavnak | G07F 11/007 221/221 |
| 7,401,709 | B2 * | 7/2008 | Stingel, Jr. | B65G 11/086 193/27 |
| 2010/0038375 | A1 * | 2/2010 | Percy | G07F 11/16 221/95 |
| 2016/0133083 | A1 * | 5/2016 | Erikawa | G07F 11/005 221/289 |

* cited by examiner

PRODUCT DISCHARGE DEVICE FOR VENDING MACHINE

RELATED APPLICATIONS

The present application is based on, and claims priority from Japanese Application No. JP2015-236895 filed Dec. 3, 2015, the disclosure of which is hereby incorporated by reference herein in its entirety.

TECHNICAL FIELD

The present invention relates to a product discharge device for a vending machine capable of aligning long-size products into a line and accommodating half-size products into two rows, and capable of individually carry out the long-size products and the half-size product by the product discharge or carry-out device placed in the vicinity of an outlet of a produce accommodation passage.

BACKGROUND ART

An automatic dispenser or vending machine which sells products, such as canned beverages, PET bottle beverages is configured such that the products are divided into cold products and hot products in a product accommodating storage of body cabinet as a heat insulating casing, a plurality of product samples is laterally arranged and displayed in an outer door display chamber, and a product selected based on operation of project-selection buttons provided corresponding to the project samples. This kind of automatic dispenser will be described using FIG. 15.

As shown in FIG. 15, this automatic dispenser includes a body cabinet 100 whose front surface is opened, and an outdoor 160 supported on a front surface of the body cabinet 100 such that the outdoor 160 can open and close through a hinge. Heat insulation boards composed of urethane foam is placed on an inner side, i.e., outer wall, left and right walls, and a back wall 110 of a steel plate of the body cabinet 100, so that the body cabinet 100 is configured as a heat insulation casing. The inside of a produce accommodating storage surrounded by heat insulation of the body cabinet 100 is laterally divided into a plurality of product accommodating chambers 130, 140 and 150 by product accommodating storages 120. In this example, product accommodating racks 180 having meandering passages called serpentine are respectively accommodated in the product accommodating chambers 130, 140 and 150. An inner door 170 is placed between the outdoor 160 which is supported by the front surface of the body cabinet 100 such that the outdoor 160 can open and close and a front surface of the project accommodating storage of the body cabinet 100. In this example, the inner door 170 is divided into upper and lower portions. The lower inner door 170 is provided with a product carry-out port having a carrying-out door 170*a* opposed to a shooter 190 which sends out a product carried out from the product accommodating rack 180 of the product accommodating chambers 130, 140 and 150. An upper inlet of the carrying-out door 170*a* is pivotally supported and suspended, closes the product carry-out outlet by its own weight, and thereby preventing cold air or warm air from flowing out. The carrying-out door 170*a* is pushed and opened by a product which is carried out through the shoot 190, and the project is sent out to a product carry-out outlet 160*a* of the outdoor 160. An upper region of the front surface of the outdoor 160 is formed as a display chamber covered with a transparent plate for displaying the project samples, a product selection button unit is provide on a front surface of the transparent plate, and the product selection button unit includes product-selection buttons provided in correspondence to the displayed product samples. The front surface of the outdoor 160 is provided with a bill-insertion slot, a coin-insertion slot, a return lever, a product take-out opening, a handle lock and the like.

As shown in FIG. 16, each of the product accommodating racks 180 includes a pair of left and right rack side plates 181, 181 made of flat thin steel plate, a plurality of (five in the drawing) front and rear rows of meandering product accommodating passages (product columns) 183 placed between a pair of front and rear curved rail segment rows 182 which is opposed to the left and right rack side plates 181, 181 such that the rail segment rows 182 are deviated from the left and right rack side plates 181, 181 in the vertical direction by half pitch, a top tray 184 which connects, to each other, a product insertion port SL (see FIG. 15) formed at a front surface opening of the body cabinet 100 and an upper inlet of product accommodating passages 183 after second raw, product carry-out devices 200 placed at the lower end outlets of the respective product accommodating passages 183, and outlet-adjusting plates 290 opposed to the product carry-out devices 200 while sandwiching the product accommodating passages. In this example, each of the product accommodating racks 180 includes a front side product accommodating rack 180*a* having two rows of product accommodating passages 183, and a rear side product accommodating rack 180*b* having three rows of product accommodating passages 183. Rack-side hook clamps 811, 811 provided in upper ends of the pair of left and right left and right rack side plates 181, 181 of the product accommodating racks 180*a*, 180*b* are locked to and fixed to the body-side hook clamp (not shown).

Each of the product carry-out devices 200 includes a first stopper member 220 which moves toward a projecting position which projects to the product accommodating passage 183 in a state where a number one-sales product (sales product) is held, and the first stopper member 220 can move to a retreating position retreating from the product accommodating passage 183 in a state where the holding state of the sales product is released. The product carry-out device 200 also includes a second stopper member 230 which moves toward a projecting position projecting into the product accommodating passage 183 in a state where the second stopper member 230 holds a number two-sales product (sales product) which follows after the number one-sales product, and which moves to a retreating position retreating from the product accommodating passage 183 in a state where the holding state of the sales product is released. The first stopper member 220 and the second stopper member 230 are made to come into and out from the product accommodating passage 183 by alternately exciting and demagnetizing solenoid as driving means, thereby carrying out the sales product while holding the next sales product by the second stopper member 230.

In this automatic dispenser, to handle products having different sizes (e.g., canned beverages of 170 ml, PET bottle beverages of 500 ml), different kinds of product accommodating racks 180 are prepared in accordance with lateral width corresponding to length of products (lateral width in direction of product accommodating passages) (usually two kinds of product accommodating racks having relatively short products and relatively long products). In this case, to arrange the short products on the side of the pair of left and right rack side plates 181, 181, a passage width adjusting plate (not shown) which brings one of the rack side plate 181 toward and away from the other rack side plate 181 is placed, the passage width adjusting plate is moved and adjusted in accordance with a length of a product, thereby determining the product accommodating passages width. Further, due to diversification of products, short products (half-size product, hereinafter) less than half of long products (long-size produce) hereinafter appear. When the long-size products are replaced by the half-size products for sale, if the a passage width of the product accommodating passage 183 in which the long-size products are arranged in one row is determined to a width of the half-size products by moving and adjusting the passage width adjusting plate, two rows of product accommodating passages capable of accommodating half-size products are formed on left and right sides based on the passage width adjusting plate as a border. Therefore, it is known that the product accommodating rack 180 which can accommodate the long-size products by arranging and accommodating the half-size products in two rows can also be used as product accommodating rack 180 for the half-size products. In this case, corresponding to the half-size products accommodated in two row, two product carry-out devices 200 are placed in the vicinity of the outlet of the product accommodating passage 183, and when the long-size products are to be sold, two product carry-out devices 200 are controlled in synchronization to carry out the long-size products, and when the half-size products are to be sold, two product carry-out devices 200 are individually controlled, and the half-size products are individually carried out (e.g., see Patent Literature 1).

CITATION LIST

Patent Literature

Patent Literature: JP 3198813 B2

SUMMARY OF INVENTION

Technical Problem

The invention described in Patent Literature 1 is excellent in that a product accommodating rack of a long-size produce can also be used as a product accommodating rack of a half-size products. The invention described in Patent Literature 1 is configured such that two product carry-out devices 200 are arranged side by side in correspondence to half-size products which are arranged and accommodated in two rows, and when the long-size products are to be sold, the two product carry-out devices 200 are controlled in synchronization to carry out the long-size products, and when a half-size products are to be sold, the two product carry-out devices 200 are individually controlled to carry out the product. As described above, since the long-size products are to be sold, the two product carry-out devices 200 are controlled in synchronization, when solenoid as driving means of any one of the product carry-out devices has failure, the long-size products cannot be sold. That is, a malfunction ratio increases for the number of the driving means increased, and there is a problem that even if the products are accommodated in the product accommodating rack, a selling chance may be missed.

The present invention has been accomplished in view of the above point, and it is an object of the invention to solve the above problem, and to provide a product carry-out device of an automatic dispenser capable of reducing, as small as possible, the missing of selling chance caused by failure of driving means.

Solution to Problem

To achieve the object, in the invention, a product carry-out device of an automatic dispenser is placed near an outlet of a product accommodating passage which arranges and accommodates long-size products in one row in a sideways attitude, and which arranges and accommodates half-size products in two rows in a longitudinal direction in a sideways attitude. The product carry-out device includes two sets of first stopper members and second stopper members which are provided in correspondence with half-size products arranged and accommodated in two rows. The first stopper members and the second stopper members appear in a product accommodating passage, and hold and open the products. When the long-size products are to be sold, the two sets of first stopper members and second stopper members are driven synchronously to carry out the long-size products accommodated in the product accommodating passage, and when the half-size products are to be sold, the two sets of first stopper members and second stopper members are individually driven to carry out the half-size products accommodated in the product accommodating passage. The product carry-out device includes a single driving means for driving the two sets of first stopper members and second stopper members, a link mechanism having two sets of link members provided in correspondence with the two sets of first stopper members and second stopper members and supporting lower link pins and upper link pins for moving the two sets of first stopper members and second stopper members to a projecting positions and a retreating position, a connection mechanism for connecting the single driving means and the link mechanisms to each other, and switching means for selectively connecting and disconnecting the connection mechanism and the link mechanism to and from each other. The two sets of first stopper members and second stopper members are driven synchronously by connecting the connection mechanism and the two sets of link members of the link mechanisms to each other by the switching means, the connection mechanism and one or the other of the two sets of link members of the link mechanisms are connected to each other by the switching means, the connection mechanism and the one or the other of the two sets of link members of the link mechanisms are separated from each other, thereby individually driving one or the other of the two sets of first stopper members and second stopper members.

In the product carry-out device of the automatic dispenser according to the first aspect, in the invention of the second aspect, the switching means includes two sets of solenoids.

Advantageous Effects of Invention

The product carry-out device of an automatic dispenser according to the first aspect is placed near an outlet of a product accommodating passage which arranges and accommodates long-size products in one row in a sideways attitude, and arranges and accommodates half-size products in two rows in a longitudinal direction sideways, in which the product carry-out device includes two sets of first stopper members and second stopper members which are provided in correspondence with half-size products arranged and accommodated in two rows. The first stopper members and the second stopper members appear in a product accommodating passage and hold and open the products, and when the long-size products are to be sold, the two sets of first stopper members and second stopper members are driven synchronously to carry out the long-size products accommodated in the product accommodating passage, and when the half-size products are to be sold, the two sets of first stopper members and second stopper members are individually driven to carry out the half-size products accommodated in the product accommodating passage. The product carry-out device includes a single driving means for driving the two sets of first stopper members and second stopper members, a link mechanism having two sets of link members provided in correspondence with the two sets of first stopper members and second stopper members and supporting lower link pins and upper link pins for moving the two sets of first stopper members and second stopper members to a projecting positions and a retreating position, a connection mechanism for connecting the single driving means and the link mechanisms to each other, and switching means for selectively connecting and disconnecting the connection mechanism and the link mechanism to and from each other. The two sets of first stopper members and second stopper members are driven synchronously by connecting the connection mechanism and the two sets of link members of the link mechanisms to each other by the switching means, the connection mechanism and one or the other of the two sets of link members of the link mechanisms are connected to each other by the switching means, the connection mechanism and the one or the other one of the two sets of link members of the link mechanisms are separated from each other, thereby individually driving one of or the other of the two sets of first stopper members and second stopper members. According to this, two sets of first stopper members and second stopper members which are provided in correspondence with half-size products arranged and accommodated in two rows and which appears in the product accommodating passage to hold and open the products can be driven by the single driving means. When driving means which individually drives the two sets of first stopper members and second stopper members are provided as in the conventional device, a failure rate becomes high, and if the driving means fails to operate properly, products, especially long-size products cannot be sold, but the present invention has an effect that it is possible to reduce the failure rate of the driving means, and to miss the product sales chance.

According to the product carry-out device of an automatic dispenser according to the second aspect, in the product carry-out device of an automatic dispenser according to the first aspect, the switching means includes two sets of solenoids. By selecting the two sets of solenoids, it is possible to individually drive one or the other of the two sets of first and second stopper members.

MODE FOR CARRYING OUT THE INVENTION

A product carry-out device of an automatic dispenser of an embodiment of the present invention will be described in detail based on the attached drawings.

Figure 1:
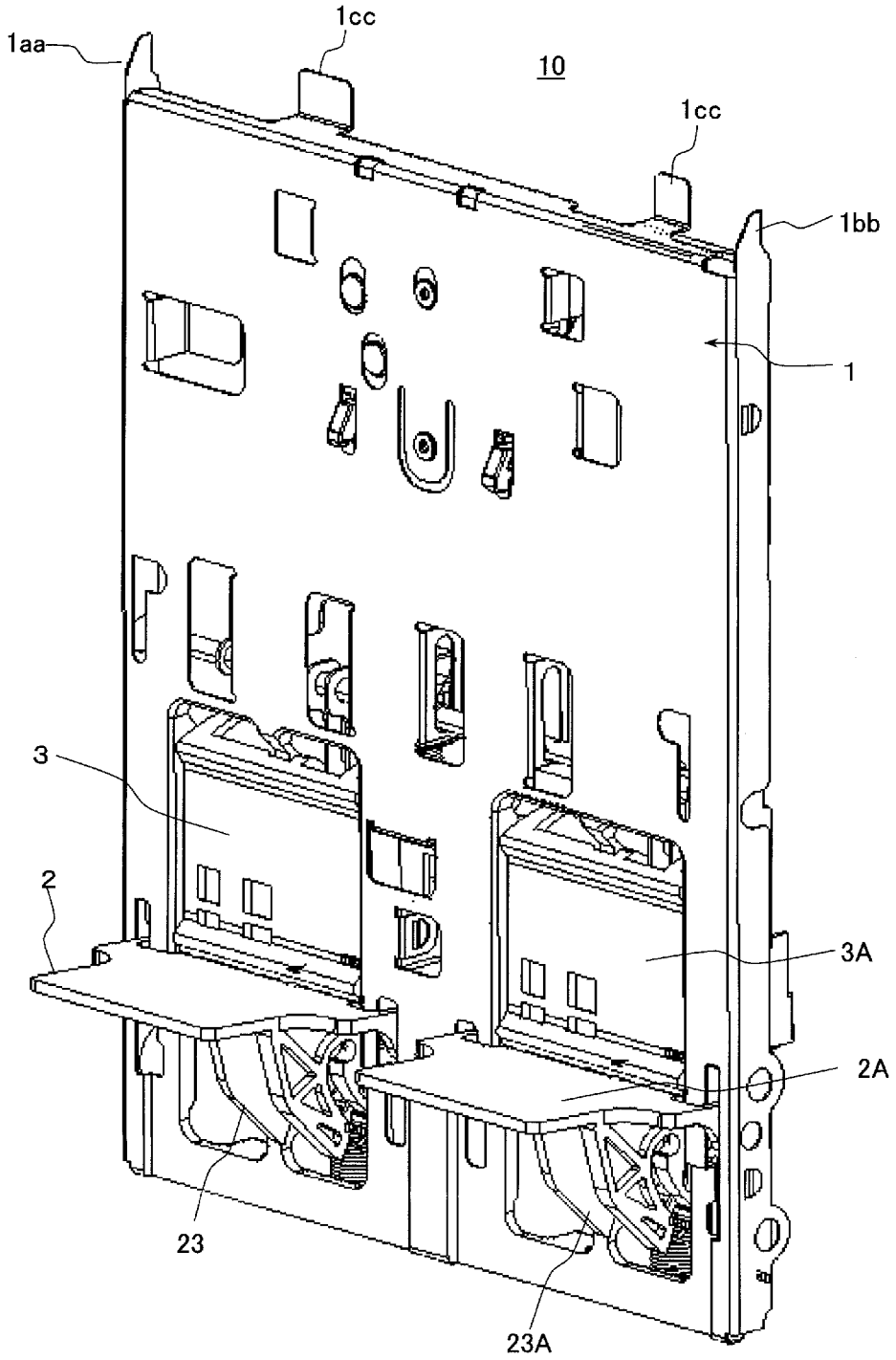
FIG. 1 illustrates a front perspective view showing a product carry-out device of an automatic dispenser or product discharge device for a vending machine according to an embodiment of the present invention.
Figure 2:
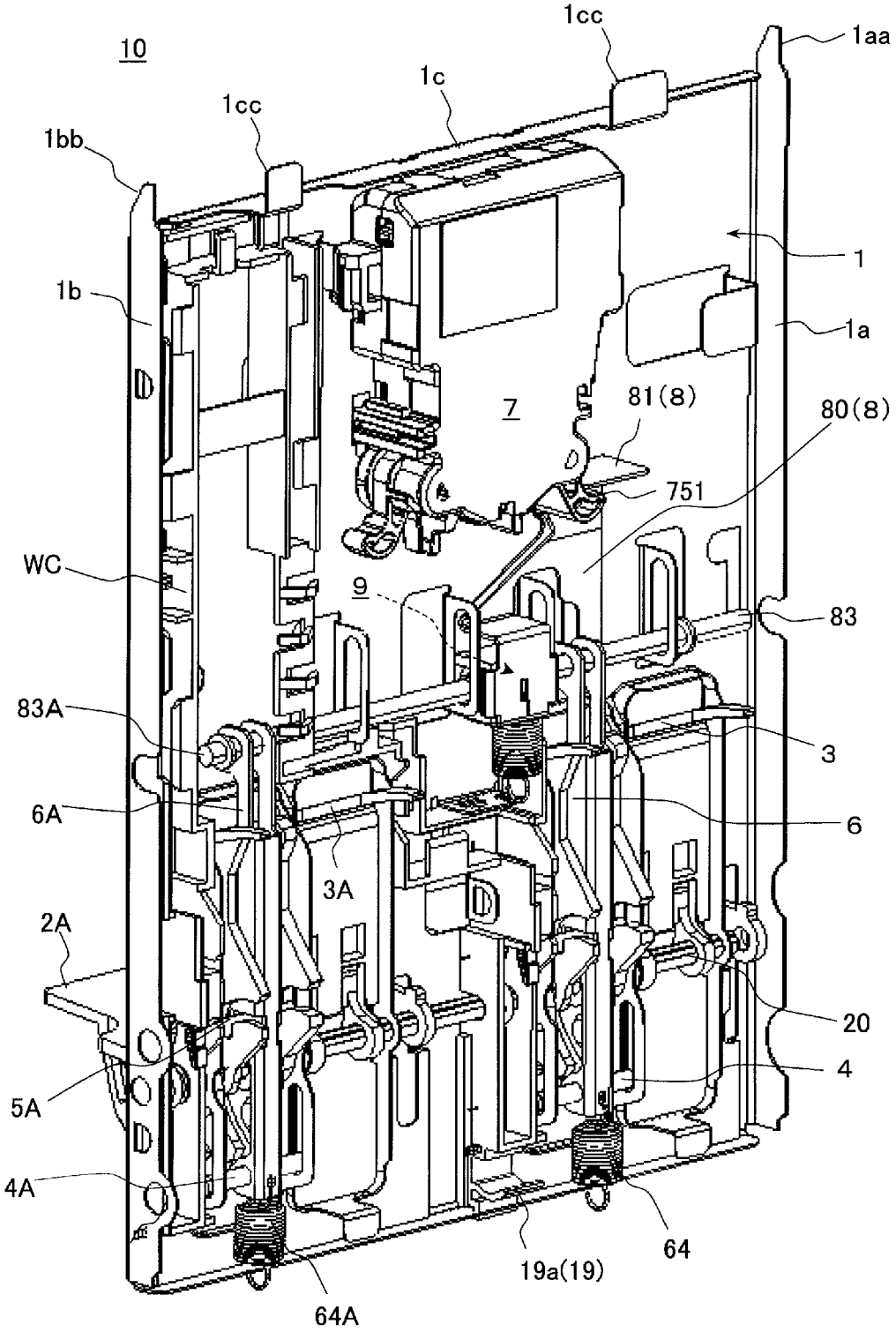
FIG. 2 illustrates a back perspective view of the product carry-out device FIG. 1.
Figure 16:
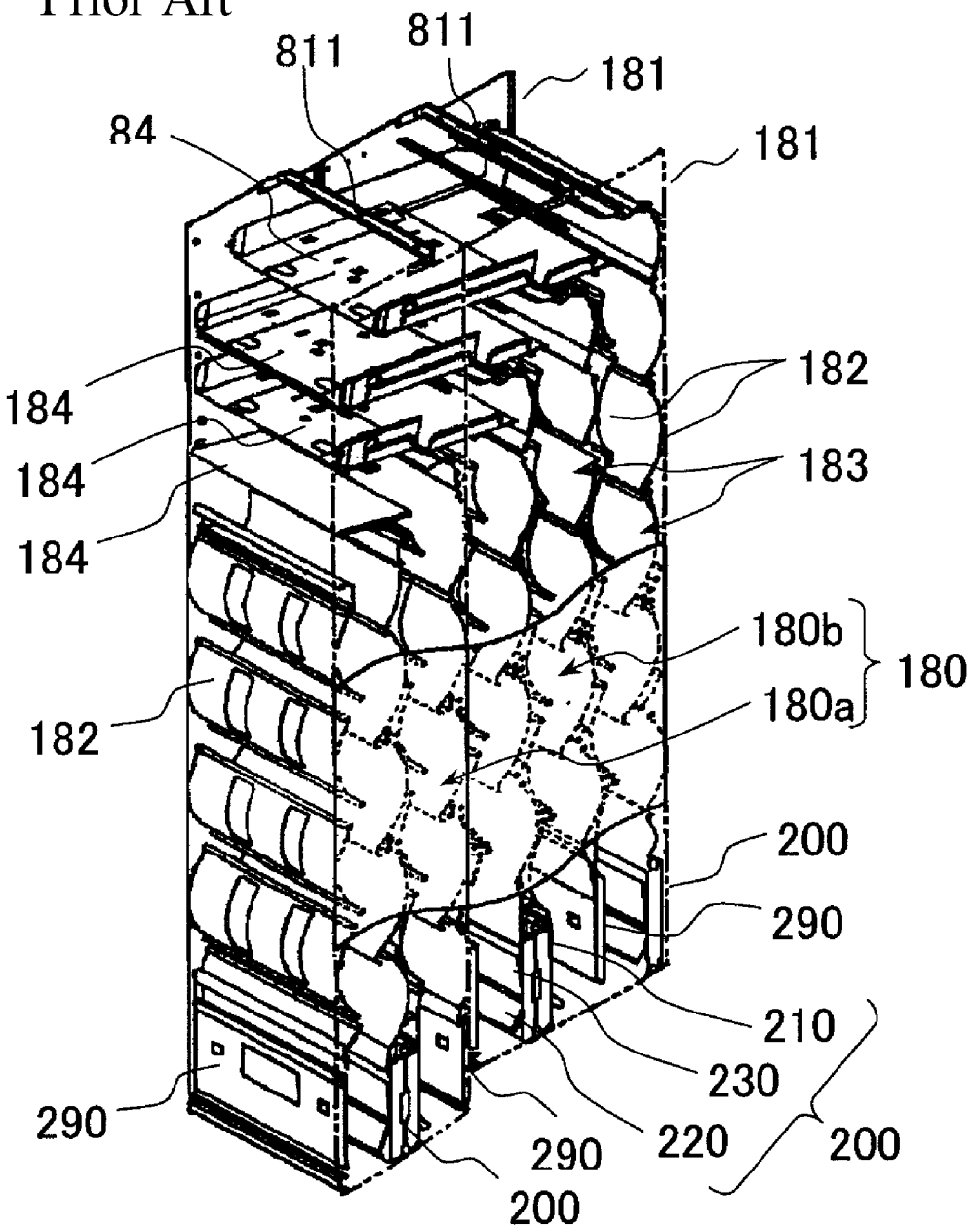
FIG. 16 Prior Art
FIG. 16 is a perspective view of a product accommodating rack in the automatic dispenser of FIG. 15.

As shown in FIGS. 1 and 2, the product carry-out device 10 includes a substrate 1. The substrate 1 is formed into a rectangular flat plate made of thin steel plate. The substrate 1 has a width corresponding to lengths of long-size products which are arranged and accommodated in one row in product accommodating passages 183 (see FIG. 16) in its side manner. Placed on a back surface of the substrate 1 are two sets of link mechanisms 6, 6A which support two sets of first stopper members 2, 2A, two sets of second stopper members 3, 3A, two sets of lower link pins 4, 4A, and upper link pins 5, 5A; a single motor driving unit 7, a connection mechanism 8 for connecting the two sets of link mechanisms 6, 6A and the single motor driving unit 7 to each other; and switching means 9. The link mechanisms 6, 6A support the two sets of first stopper members 2, 2A, the second stopper members 3, 3A, the lower link pins 4, 4A and the upper link pins 5, 5A. Among them, a set of the link mechanism 6 supporting the first stopper member 2, the second stopper member 3, the lower link pin 4 and the upper link pin 5 forms a product carry-out mechanism (this set is called first carry-out mechanism hereinafter) of one of rows of half-size products which are arranged and accommodated laterally in two rows in a longitudinal direction in the product accommodating passages 183 (see FIG. 16). A set of the link mechanism 6A supporting the first stopper member 2A, the second stopper member 3A, the lower link pin 4A and the upper link pin 5A forms a product carry-out mechanism (this set is called second carry-out mechanism hereinafter) of the other row of half-size products. The link mechanism 6 which supports the first stopper member 2, the second stopper member 3, the lower link pin 4 and the upper link pin 5 of the first product carry-out mechanism, and the link mechanism 6A which supports the first stopper member 2A, the second stopper member 3, the lower link pin 4A and the upper link pin 5A of the second product carry-out mechanism are made by the same members. In the following description, for corresponding to the second carry-out mechanism, "A" is added to reference signs of the first carry-out mechanism, and explanation thereof will be omitted.

Engaging portions 1*aa*, 1*bb* which engage with pin members P, P (see FIG. 10) provided on rack side plates 181, 181 (see FIG. 16) are provided on upper portions of left and right flanges 1*a*, 1*b* (see FIG. 4) of the substrate 1. An engaging portion 1*cc* which engages the pin member P of the upper portion is provided on an upper flange 1*c* of the substrate 1. A holder 9 which engages a lower flange 1*d* of the substrate 1 is provided on the upper flange 1*c* of the substrate 1. The holder 9 is engaged with and disengaged from the lower pin member p. These configurations are the same as those of the conventional device. Here, "left and right" means "left and right" when a surface opposite from the back surface on which the flanges 1*a* to 1*d* of the substrate 1 are provided is defined as a front surface.

Figure 4:
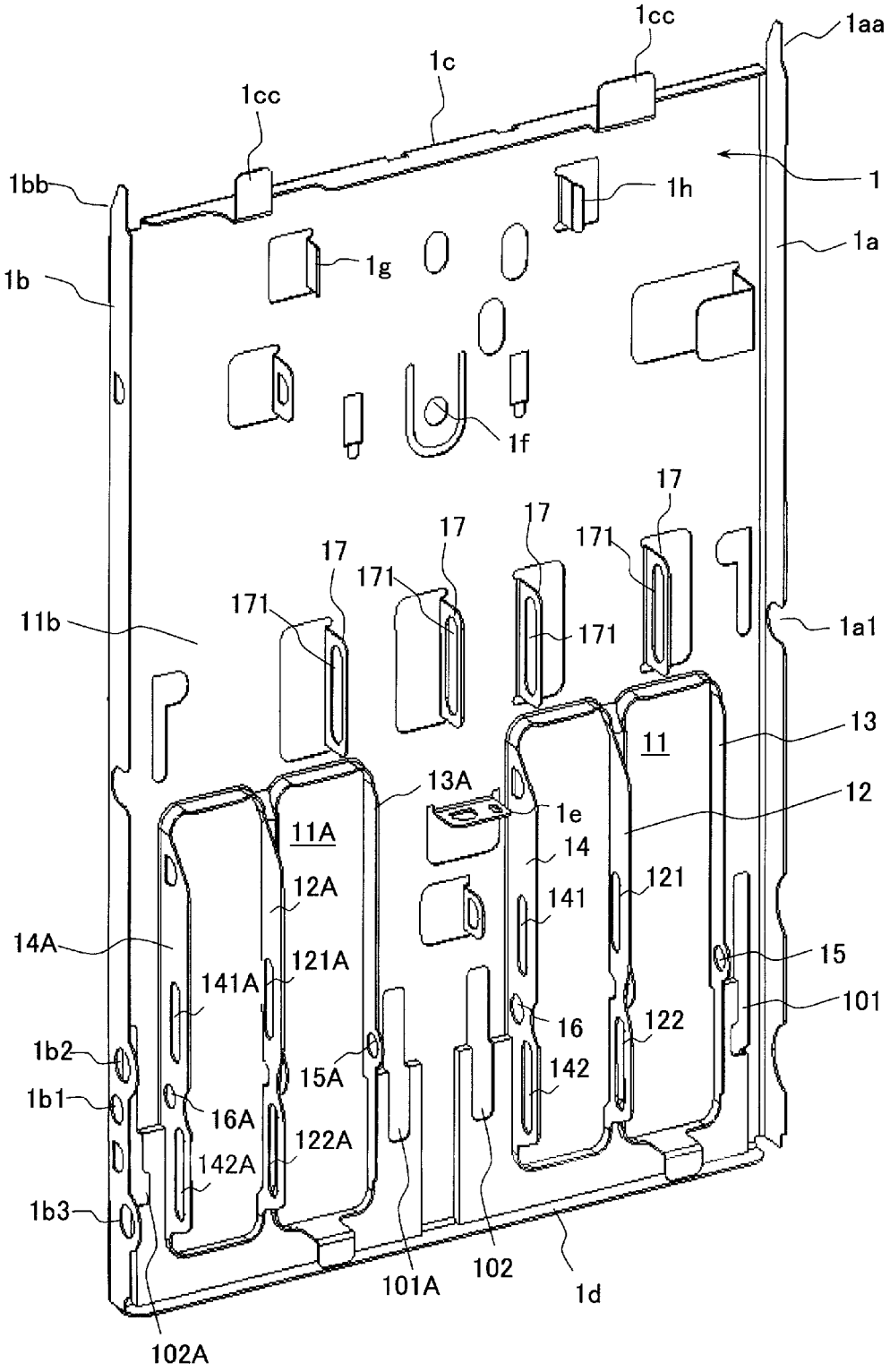
FIG. 4 illustrates a back perspective view showing a substrate in the product carry-out device of FIG. 1.

As shown in FIG. 4 also, openings 11 (11A) are formed in left and right portions of a lower half region of the substrate 1. An upper half region of the substrate 1 is formed as a placement position of the motor driving unit 7. Bearing portions 12 (12A) face the left and right openings 11 (11A) formed in the substrate 1. The bearing portions 12 (12A) are located substantially central portion of the openings 11 (11A) in the lateral direction.

The bearing portions 12 (12A) support ends of the lower link pins 4, 4A and the upper link pins 5, 5A supported by the link mechanisms 6, 6A. The bearing portions 12 (12A) also support a central region of a common turning shaft 20 (later described) related to the first stopper members 2, 2A and the second stopper member 3. The other ends of the lower link pins 4, 4A and the upper link pins 5, 5A project toward left and right edges of the openings 11 (11A) of the substrate 1 on the side of the back surface of the substrate 1, and the other ends are supported by flanges 14 (14A). Both ends of the turning shaft 20 are supported by flanges 13 (13A) formed such that they project from the left edge of the openings 11 on the side of the back surface of the substrate 1, and are also supported by the flange 14A formed such that it projects from a right edge of the opening 11A on the side of the back surface of the substrate 1. Configurations which support the lower link pins 4, 4A and the upper link pins 5, 5A in the bearing portions 12 (12A) and the flanges 13, 14 are substantially symmetric. Therefore, in the following description, after the bearing portions 12 (12A) are described, configurations concerning the flanges 13, 14 will be described.

The bearing portions 12 (12A) are integrally connected to upper edges and lower edges of the openings 11 (11A) formed in the substrate 1, and float up from the back surface side by the flat plate surface of the substrate 1. The bearing portions 12 (12A) laterally bisect the openings 11 (11A). When the openings 11 (11A) in the substrate 1 are formed, the bearing portions 12 (12A) are integrally formed on the substrate 1 while leaving a portion of the plate surface of the substrate 1 to divide the openings 11 (11A) laterally. A bent portion toward the back surface is superposed to enhance the mechanical strength. The bearing portions 12 (12A) are provided with a pair of vertically extending upper and lower long holes 121, 122 (121A, 122A). Arc recesses (reference sign is omitted) are formed in a front surface and a back surface of the pair of upper and lower long holes 121, 122 (121A, 122A) of the bearing portions 12 (12A) at substantially central positions. In the recesses, the front surface side recess is for avoiding interference with the turning shaft 20. The back surface side recess is for avoiding interference between the turning shaft 20 and the (later-described) other product carry-out device (see FIG. 13) which is bundled back to back. Hole peripheries of the pair of upper and lower long holes 121, 122 (121A, 122A) are subjected to Hemming process or Burring process to reduce friction with the turning shaft.

The flanges 14 (14A) formed on right edges of the openings 11 (11A) are provided with long holes 141, 142 (141A, 142A) corresponding to the pair of upper and lower long holes 121, 122 (121A, 122A) of the bearing portions 12 (12A). Spindle holes 16 (16A) are provided in substantially intermediate positions of the pair of upper and lower long holes 141, 142 (141A, 142A) in the flanges 14 (14A). The flanges 13 (13A) formed on the left edges off the openings 11 (11A) are provided with spindle hole 15 (15A) on the same line as the spindle holes 16 (16A) provided in the flanges 14 (14A).

The spindle hole 15 (15A) provided in the flanges 13 (13A) and the spindle holes 16 (16A) provided in the flanges 14 (14A) support the turning shaft 20 which is common to the first stopper members 2, 2A and the second stopper members 3, 3A. The long holes 122 (122A) provided in the bearing portions 12 (12A) and the long holes 142 provided in the flanges 14 (14A) formed on the right edges of the openings 11 (11A) support the lower link pins 4, 4A supported by the link mechanism. 6 such that the lower link pins 4, 4A can slide in the vertical direction. The long holes 121 (121A) provided in the bearing portions 12 (12A) and the long holes 141 (141A) provided in the flanges 14 (14A) support the upper link pins 5, 5A supported by the link mechanism 6 such that the upper link pins 5, 5A can slide in the vertical direction. Hole peripheries of the spindle holes 16 (16A) and the long holes 141, 142 (141A, 142A) are subjected to Hemming process or Burring process to reduce friction with the lower link pins 4, 4A and the upper link pins 5, 5A.

Four guide portions 17 are formed, in the lateral direction, in intermediate positions of the substrate 1 in the vertical direction. The guide portions 17 are formed by cutting the substrate 1 and raising the same, and vertically extending guide grooves 171 are provided. The guide portions 17 guide slide pins 83 of a later-described connection mechanism 8.

Figure 3:
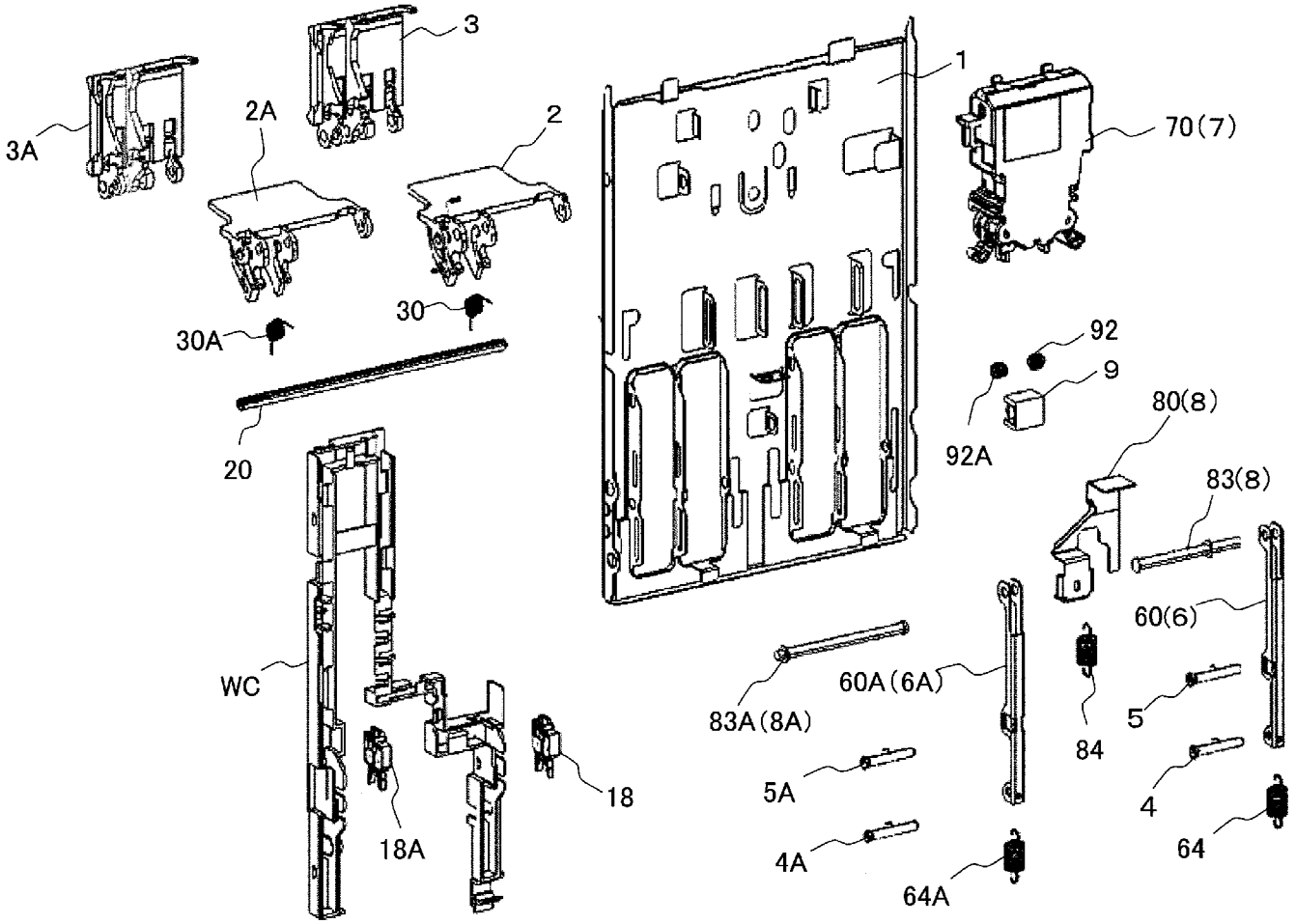
FIG. 3 illustrates an exploded perspective view of the product carry-out device of FIGS. 1 and 2.

As shown in FIG. 2, the first stopper members 2, 2A are interposed between the flanges 13, 14 (13A, 14A) formed on left and right both edges of the openings 11 (11A) of the substrate 1. The first stopper members 2, 2A are turnably supported by the turning shaft 20. The first stopper members 2, 2A turn around the turning shaft 20. The first stopper members 2, 2A can move between projecting positions respectively projecting from the openings 11 (11A) of the substrate 1 to the product accommodating passage 183 (see FIG. 16) and retreating positions retreating from the product accommodating passage 183 to close the openings 11 (11A). A torsion coil springs 30 (30A) shown in FIG. 3 are wound around the turning shaft 20. The first stopper members 2, 2A are always biased toward the projecting positions by resilient biasing forces of the torsion coil springs 30 (30A), and surfaces (upper surfaces) of the first stopper members 2, 2A are formed as holding portions which hold a product G (see FIG. 11) at the projecting positions.

Figure 5:
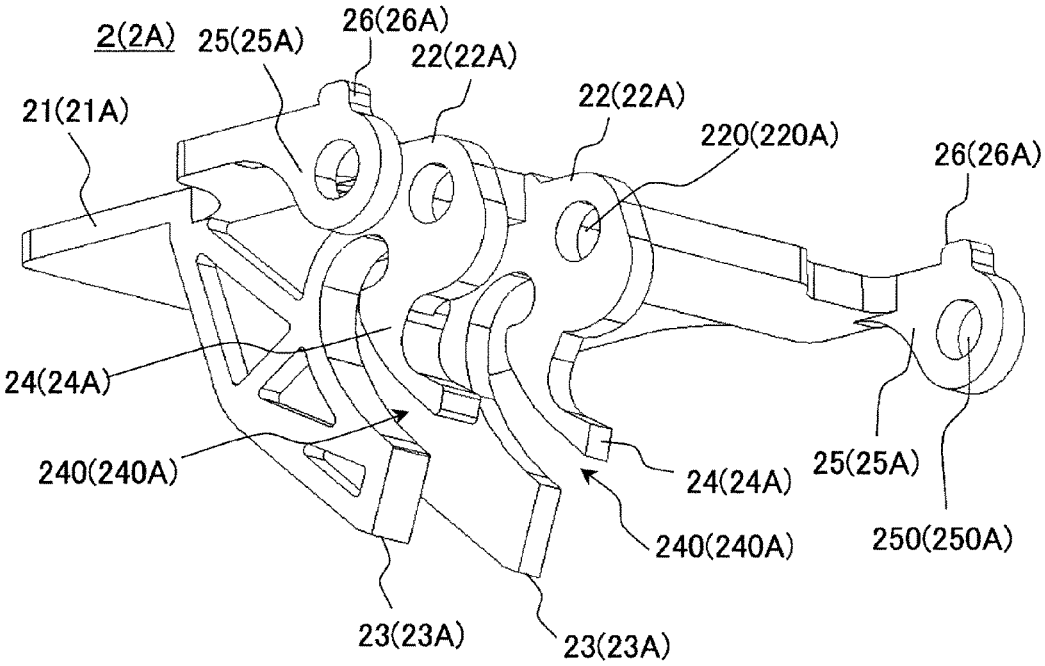
FIG. 5 illustrates a back perspective view of first stopper member(s) in the product carry-out device of FIG. 1.

As shown in FIG. 5, the first stopper members 2, 2A are made of synthetic resin (e.g., polyacetal) formed by integrally forming two bearing portions 22 (22A) on back surfaces of flat plate-shaped holding portions 21 (21A). A pair of left and right spindle portions 25 (25A) having shaft-insertion holes 250 (250A) projects from left and right both ends of the holding portions 21 (21A) on the side of the base end. Sold-out detecting pieces 26 (26A) are formed close to outer sides of the pair of left and right spindle portions 25 (25A). The turning shaft 20 is inserted into the shaft-insertion holes 250 (250A) of the spindle portions 25 (25A). The spindle portions 25 (25A) are formed such that they are inserted into the long holes 101, 102 (101A, 102A) formed on left and right both sides of the openings 11 (11A) of the substrate 1 and then the turning shaft 20 is inserted into the shaft-insertion holes 250 (250A).

The two bearing portions 22 (22A) are deviated to one side in two sides in the lateral direction of the flat plate-shaped holding portions 21 (21A). Widths of the two bearing portions 22 (22A) in the lateral direction are smaller than widths of openings (spaces) bisected by the bearing portions 12 (12A) in the openings 11 (11A) of the substrate 1, and the widths are determined such that the bearing portions 22 (22A) can pass through the spaces. The bearing portions 22 (22A) are deviated from the centers of the holding portion 21 (21A) toward one of lateral sides (in FIG. 4, opening (space) between the bearing portions 12 (12A) in the openings 11 (11A) and the flanges 14 (14A) of the openings 11 (11A). This is because, when the two product carry-out devices are bundled with each other back to back, the first stopper members 2, 2A of one of the product carry-out devices and the first stopper members 2, 2A of the other product carry-out device do not interfere with each other. Base ends of the two bearing portions 22 (22A) are provided with shaft-insertion holes 220 (220A). The turning shaft 20 is inserted into the shaft-insertion holes 220 (220A). The shaft-insertion holes 220 (220A) are located on the same axis as the shaft-insertion holes 250 (250A) of the spindle portions 25 (25A) formed on left and right both ends of the holding portions 21 (21A). Arc locking projections 23 (23A) respectively project from base ends of the two bearing portions 22 (22A). Arc guide projections 24 (24A) are formed from the base ends of the two bearing portions 22 (22A). The arc guide projections 24 (24A) are formed such that curved grooves 240 (240A) which guide the lower link pins 4, 4A are formed between thee arc guide projections 24 (24A) and the locking projections 23 (23A).

Tip ends of the locking projections 23 (23A) in the bearing portions 22 (22A) of the first stopper members 2, 2A abut against the lower link pins 4, 4A which move down, and lock the first stopper members 2, 2A at the projecting position of the product accommodating passages 183 (183A). If the lower link pins 4, 4A rise, the locked state is released, and permit the turning motion toward the retreating position of the first stopper members 2, 2A. When the first stopper member 2, 2A moves to the retreating position, the lower link pins 4, 4A slide along the grooves 240 (240A).

As shown in FIG. 2, the second stopper members 3, 3A are interposed between the flanges 13, 14 (13A, 14A) formed on left and right edges of the openings 11 (1A) of the substrate 1, and the second stopper members 3, 3A turnably support the turning shaft 20. The second stopper members 3, 3A turn around the turning shaft 20. The second stopper members 3, 3A can move between projecting positions which come out or come into the product accommodating passage 183 from the openings 11 (11A) of the substrate 1 selectively or in synchronization, and project toward the inside of the product accommodating passage 183, and a retreating position retreating from the product accommodating passage 183 to close the openings 11 (11A).

Figure 6:
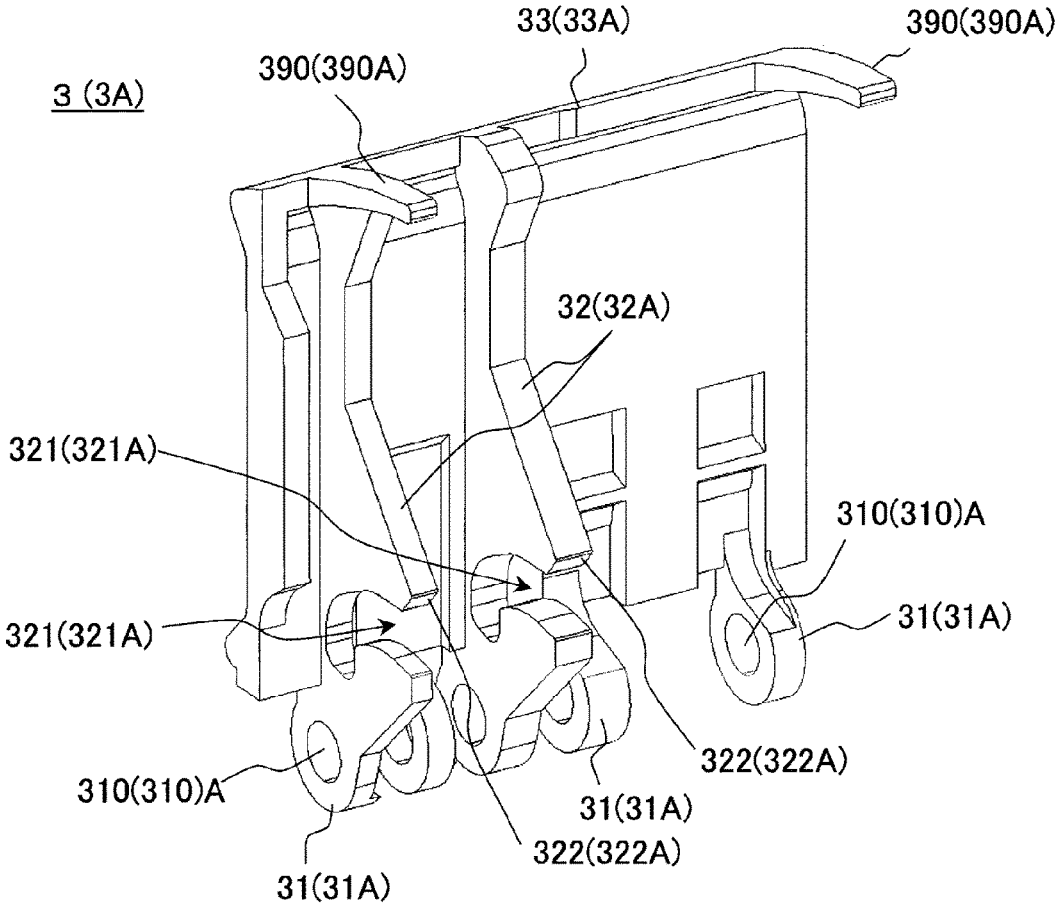
FIG. 6 illustrates a back perspective view of second stopper member(s) in the product carry-out device of FIG. 1.

As shown in FIG. 6, the second stopper members 3, 3A are made of synthetic resin (e.g., polyacetal). The second stopper members 3, 3A are integrally provided with holding portions 33 (33A) of products. The holding portions 33 (33A) include three spindle portions 31 (31A) having shaft-insertion holes 310 (310A) formed on the side of the base end, two stopper walls 32 (32A) deviated toward any one of lateral sides (left side in FIG. 6) and projecting toward the back surface, and two tongues 330 (330A) formed on the tip end side and projecting toward the back surface.

The turning shaft 20 is inserted into the shaft-insertion holes 310 (310A) of the spindle portions 31 (31A). The two spindle portions 31 (31A) having the shaft-insertion holes 310 (310A) are provided such that positions of the two bearing portions 22 (22A) in the first stopper members 2, 2A are deviated from each other.

The two stopper walls 32 (32A) of the second stopper members 3, 3A are deviated toward lateral sides (left side in FIG. 6). Widths of the two stopper walls 32 (32A) in the lateral direction are smaller than widths of openings (spaces) bisected by the bearing portions 12 (12A) in the openings 11 (11A) of the substrate 1, and the widths are determined such that the stopper walls 32 (32A) can pass through the spaces. In FIG. 4, the stopper walls 32 (32A) are formed such that they pass through the opening (space) between the bearing portions 12 (12A) in the openings 11 (11A) of the substrate 1 and the flanges 14 (14A) of the openings 11 (11A). This is because, when the two product carry-out devices are bundled with each other in the back to back manner, the second stopper members 3, 3A of one of the product carry-out devices and the second stopper members 3, 3A of the other product carry-out device do not interfere with each other.

The two stopper walls 32 (32A) include recessed sliding grooves 321 (321A) and stopper surfaces 322 (322A) formed along the groove walls of the recessed sliding grooves 321 (321A). In a state where the upper link pins 5, 5A can slide and the second stopper members 3, 3A are retreated to the retreating position, the recessed sliding grooves 321 (321A) receive the upper link pins 5, 5A. When the upper link pins 5, 5A rise and abut against the recessed sliding grooves 321 (321A), and the second stopper members 3, 3A project into the product accommodating passage 183 (when upper link pins 5, 5A pull out from the sliding grooves 321 (321A)), the stopper surfaces 322 (322A) of the stopper walls 32 (32A) abut against the upper link pins 5, 5A, and are locked at the projecting positions of the second stopper members 3, 3A.

The turning shaft 20 pivotally supports the first stopper members 2, 2A and the second stopper members 3, 3A. In the assembling of the turning shaft 20 into the substrate 1, the first stopper members 2, 2A and the second stopper members 3, 3A are placed at predetermined positions of the opening 11 of the substrate 1. Next, a tip end of the turning shaft 20 is inserted into a round hole 1*b*1 formed in the right flange 1*b* from outside of the right flange 1*b* of the substrate 1. Then, the tip end of the turning shaft 20 is inserted into spindle hole 16A formed in the flange 14A of the opening 11A, the spindle hole 15A formed in the flange 13 of the opening 11, the spindle hole 16 formed in the flange 14 of the opening 11, and the spindle hole 15 formed in the flange 13A of the opening 11A in the named order. In this case, the shaft-insertion holes 250 (250A) of the pair of left and right spindle portions 25 (25A) provided on the holding portions 21 (21A) of the first stopper members 2, 2A; the shaft-insertion holes 220 (220A) provided in the bearing portions 22 (22A) of the first stopper members 2, 2A; and the shaft-insertion holes 310 (310A) of the second stopper members 3, 3A are placed at predetermined positions such that they are located on one straight line together with the spindle hole 15, 16, (15A), (16A) formed in the flanges 13, 14, (13A), (14A). Therefore, the first stopper members 2, 2A and the second stopper members 3, 3A are pivotally supported by the turning shaft 20. A head of the turning shaft 20 is provided with a stopper, which projects radially outward, and the turning shaft 20 is inserted until the stopper abuts against the flange 14A. A wiring cover WC (see FIG. 2) provided between the right flange 1*b* and the flange 14A of the substrate 1 abuts against the head of the turning shaft 20, and this prevents the turning shaft 20 from being pulled out.

The link mechanisms 6, 6A are driven by the motor driving unit 7 through the connection mechanism 8. The lower link pins 4, 4A of the first carry-out mechanism and the second carry-out mechanism are provided in correspondence with the first stopper members 2, 2A of the first carry-out mechanism and the second carry-out mechanism. The first carry-out mechanism and the second carry-out mechanism move the first stopper members 2, 2A to the projecting position projecting to the product accommodating passage 183 and the retreating position retreating from the product accommodating passage 183. The upper link pins 5, 5A of the first carry-out mechanism and the second carry-out mechanism are provided in correspondence with the second stopper members 3, 3A and move the second stopper members 3, 3A to the projecting position projecting to the product accommodating passage 183 and to the retreating position retreating from the product accommodating passage 183. The link mechanisms 6, 6A are assembled into the substrate 1 such that the link mechanisms 6, 6A support the lower link pins 4, 4A and the upper link pins 5, 5A.

Figure 7:
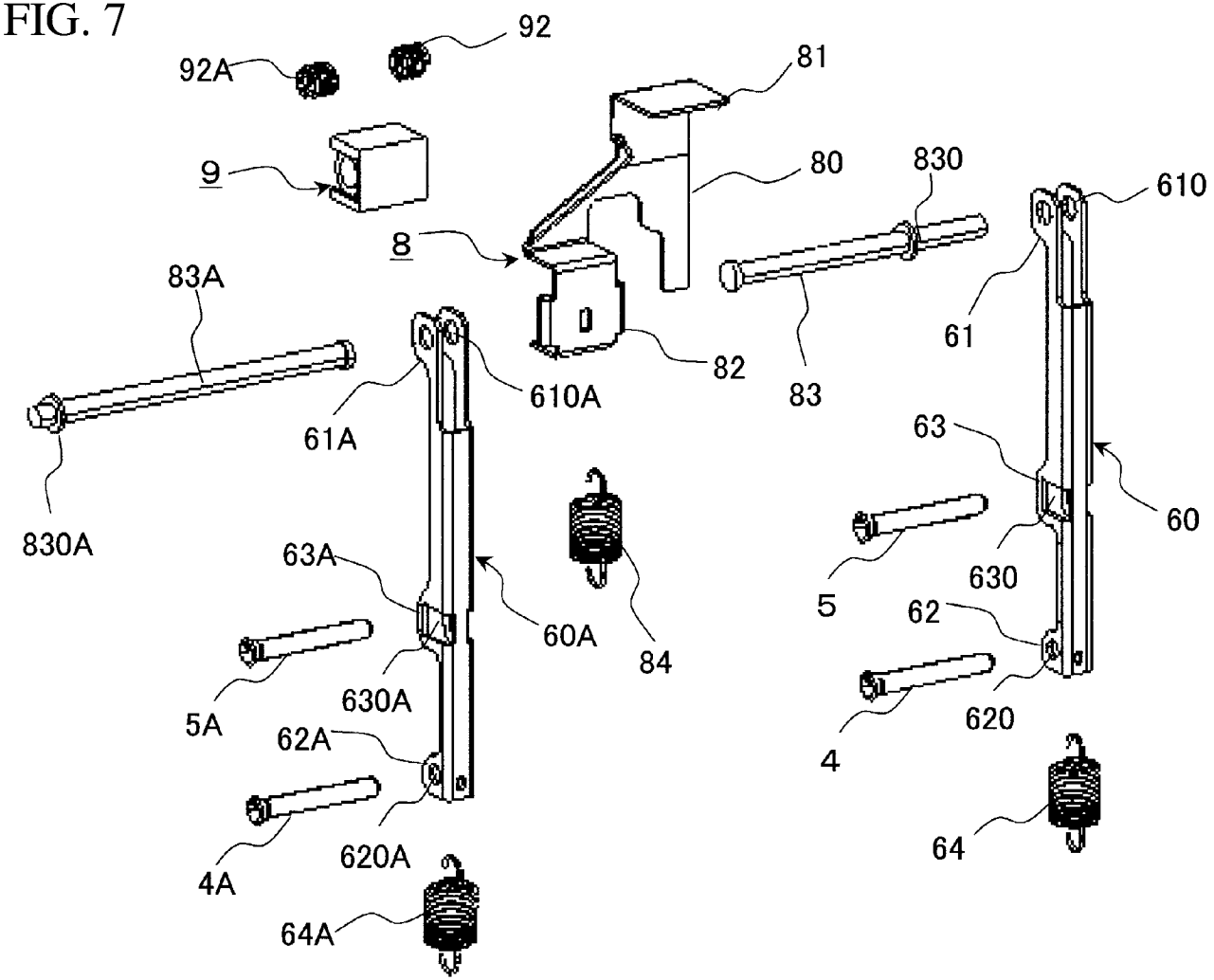
FIG. 7 illustrates an exploded perspective view showing link mechanisms, a connection mechanism and switching means in the product carry-out device of FIG. 1.

As shown in FIG. 7, the link mechanisms 6, 6A include link members 60 (60A) made of steel plate. The link members 60 (60A) are formed by bending reed-shaped steel plate into U-shape. Locking portions 61 (61A) having insertion holes 610 (610A) are formed in upper ends of both legs of U-shape of the link members 60 (60A). Slide pins 83 (83A) of a later-described connection mechanism 8 penetrate insertion holes 610 (610A) possessed by the locking portions 61 (61A). Support portions 62 (62A) having engaging holes 620 (620A) through which the lower link pins 4, 4A penetrate are formed on the lower end of both legs of the U-shape of the link members 60 (60A). Support portions 63 (63A) having engaging holes 630 (630A) through which the upper link pins 5, 5A penetrate are formed above the support portions 62 (62A) in both legs of the U-shape of the link members 60 (60A). The support portions 62 (62A) support the lower link pins 4, 4A and move the lower link pins 4, 4A in the vertical direction in association with vertical motion of the link members 60 (60A). The support portions 63 (63A) support the upper link pins 5, 5A and moves the upper link pins 5, 5A in the vertical direction in association with vertical motion of the link members 60 (60A). Ends (upper ends) of return springs 64 (64A) composed of torsion springs shown in FIG. 2 are locked below the link members 60 (60A). The other ends (lower ends) of the return springs 64 (64A) are locked to the lower flange 1*d* of the substrate 1.

The upper link pins 5, 5A and the lower link pins 4, 4A are assembled into the substrate 1 in such a manner that the link members 60 (60A) are placed at predetermined positions of the openings 11 (11A), i.e., at opening (space) positions of the bearing portions 12 (12A) of the openings 11 (11A) of the substrate 1 and the flanges 14 (14A) of the openings 11 (11A) shown in FIG. 3, and the upper link pins 5, 5A and the lower link pins 4, 4A are mounted on the substrate 1. In this case, the upper link pin 5 and the lower link pin 4 are inserted into long holes 121, 122, in this order, formed in the bearing portion 12 through long holes 141, 142 formed in the flange 14 from outside (left side of flange 14 in FIG. 4) of the right flange 14 of the openings 11 of the substrate 1. Then, by inserting the upper link pin 5 and the lower link pin 4 until stoppers 51, 41 of the head provided on the upper link pin 5 and the lower link pin 4 abut against the flange 14 of the substrate 1, the upper link pin 5 and the lower link pin 4 are assembled into the substrate 1 in a state where the upper link pin 5 and the lower link pin 4 are supported by the support portions 63, 62 from the link member 60. On the other hand, ends of the upper link pin 5A and the lower link pin 4A are inserted into the round holes 1*b*2, 1*b*3 formed in the right flange 1*b* from outside of the right flange 1*b* of the substrate 1. Next, the upper link pin 5A and the lower link pin 4A are inserted, in the named order, into the long holes 121A, 122A formed in the bearing portion 12A through the long holes 141A, 142A formed in the right flange 14A of the opening 11A of the substrate 1. By inserting the upper link pin 5A and the lower link pin 4A until the stoppers 51A, 41A of the heads provided on the upper link pin 5A and the lower link pin 4A abut against the flange 14A of the substrate 1, they are assembled into the substrate 1 in a state where the upper link pin 5A and the lower link pin 4A are supported by the support portions 63A, 62A formed on the link member 60A. The upper link pins 5, 5A and the lower link pins 4, 4A are prevented from being pulled out by the wiring cover WC (see FIG. 2) mounted on the substrate 1.

The connection mechanism 8 connects the link mechanisms 6, 6A and the motor driving unit 7 to each other. The link mechanism 6A and the motor driving unit 7 are selectively connected to and disconnected from each other by the switching means 9 such that the link mechanisms 6, 6A are driven in synchronization or one or the other of the link mechanisms 6, 6A is individually driven.

As shown in FIG. 7, the connection mechanism 8 is composed of the connection member 80 and the slide pins 83 (83A). A connection member 80 is made of steel plate, and an engaging piece 81 which is engaged with a link levers 75 (75A) of the motor driving unit 7 shown in FIG. 2 is formed on an upper end of the connection member 80. A lower end of the connection member 80 is provided with a grip 82 for gripping the switching means 9. The grip 82 includes hook-shaped locking claws 821, 822 (see FIGS. 8(*a*) and 8(*b*) also) which lock a frame 91 of the switching means 9 to sandwich the frame 91. The connection member 80 is mounted on the substrate 1 such that the connection member 80 can slide in the vertical direction. Ends (upper ends) of return springs 84 (84A) which are torsion coil springs are locked to the grip 82. The other ends (lower ends) of the return springs 84 (84A) are locked to a locking piece 1*e* formed by cutting up the substrate 1.

The slide pins 83 (83A) are rod bodies made of magnetic body, and form movable iron cores of later-described solenoids 90 (90A). The slide pins 83, (83A) are formed with ring-shaped positioning projections 830 (830A) which are slightly larger than the pin diameters. The slide pins 83, (83A) penetrate an insertion hole 610 formed in the locking portion 61 of the upper end of the link member 60, and the slide pins 83, (83A) are connected to the link member 60. The slide pins 83, (83A) are guided by left and right two guide grooves 171 of four guide portions 17 formed on the substrate 1, and can slide in the lateral direction.

The slide pins 83 (83A) are assembled into the substrate 1 such that the link members 60 (60A) are placed at predetermined positions of the openings 11 (11A) of the substrate 1, and the slide pins 83 (83A) are mounted on the substrate 1. That is, a barrel of the slide pin 83 is fitted into a notch 1*a*1 formed in the flange 1*a* of the substrate 1 in a state where a tip end (right end in FIG. 7) of the slide pin 83 is opposed to the guide grooves 171 of the guide portion 17 (right end guide portion 17 in FIG. 4) formed in the substrate 1. In this state, the slide pin 83 penetrates the guide groove 171 of the guide portion 17 and then, the slide pin 83 is inserted until the tip end of the slide pin 83 reaches the guide groove 171 of the guide portion 17 (second guide portion 17 from right in FIG. 3) which is adjacent to the guide portion 17. In this state, the slide pin 83 is held by the guide grooves 171 of the two guide portions 17, and the slide pin 83 penetrates the insertion hole 610 formed in the locking portion 61 of the upper end of the link member 60 and is connected to the link member 60 (although it is not illustrated in the drawing, slide pin 83 is prevented from being pulled out in direction opposite from inserting direction of slide pin 83). On the other hand, a barrel of the slide pin 83 is fitted into a notch 1*b*4 formed in the flange 1*b* of the substrate 1 in a state where a tip end (right end in FIG. 7) of the slide pin 83A is opposed to the guide groove 171 of the guide portion 17 (left end guide portion 17 in FIG. 3) formed in the substrate 1. In this state, the slide pin 83 penetrates the guide groove 171 of the guide portion 17, and the slide pin 83 is inserted until a tip end of the slide pin 83 reaches the guide groove 171 of the guide portion 17 (second guide portion 17 from left in FIG. 4) which is adjacent to the former guide portion 17. In this state, the slide pin 83 is held by the guide grooves 171 of the two guide portions 17, the slide pin 83 penetrates the insertion hole 610A formed in the locking portion 61A on the upper end of the link member 60A, and the slide pin 83 is connected to the link member 60A (although it is not illustrated in the drawing, slide pin 83 is prevented from being pulled out in direction opposite from inserting direction of slide pin 83A).

The switching means 9 grasped by the grip 82 of the connection member 80 connects and disconnects a connection member 81 of the connection mechanism 8 and the pair of slide pins 83 (83A) to and from each other. The switching means 9 connects the connection mechanism 8 and the link mechanisms 6, 6A to each other by connecting the connection member 81 of the connection mechanism 8 and the pair of slide pins 83 (83A) to each other, and the switching means 9 connects the connection mechanism 8 and one of or the other one of the link mechanisms 6, 6A by selectively connecting and disconnecting the connection member 81 and the pair of slide pins 83 (83A).

Figure 8A:
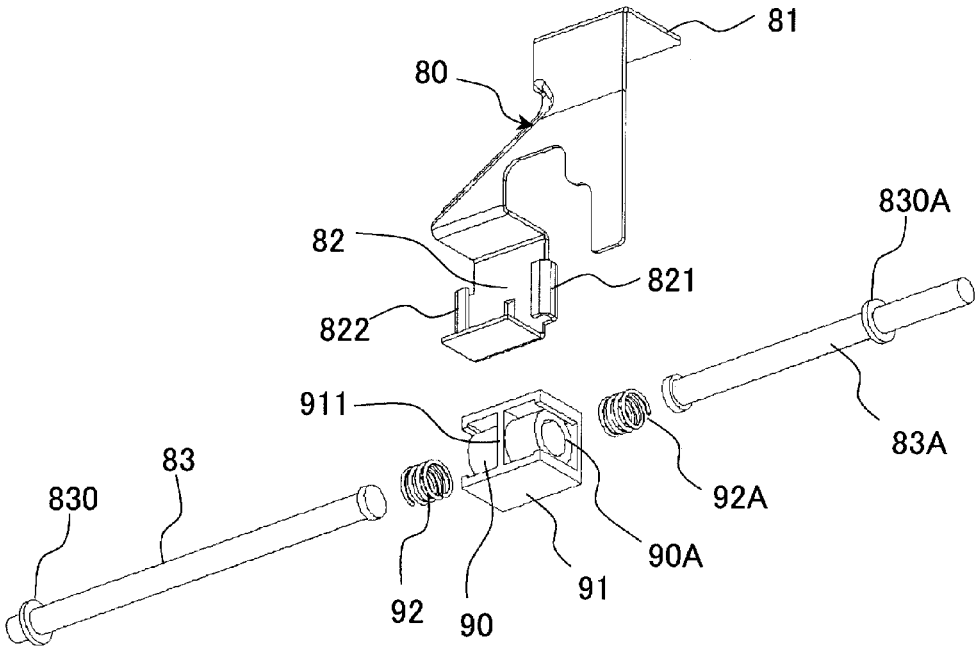
FIGS. 8(*a*) and 8(*b*) illustrate the connection mechanism and the switching means of FIG. 7, wherein FIG. 8(*a*) illustrates an exploded perspective view and FIG. 8(*b*) illustrates a perspective view of an assembled state.
Figure 8B:
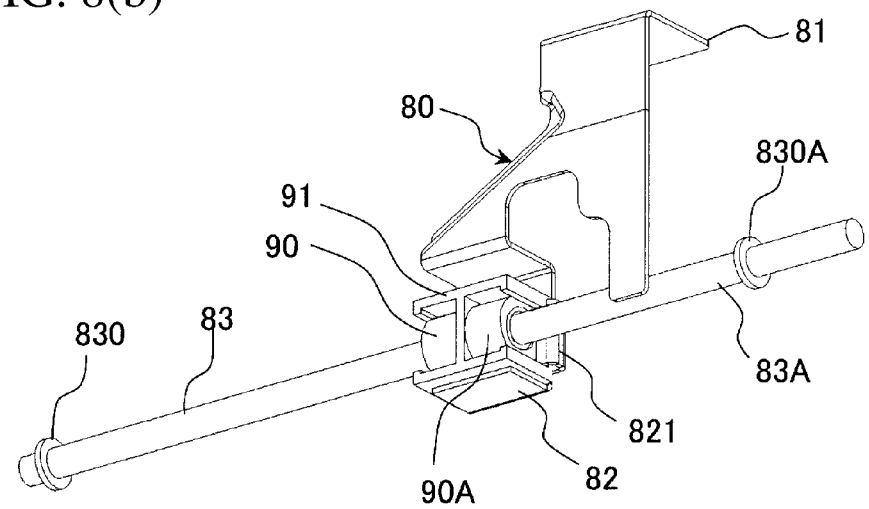

As shown in FIGS. 8(*a*) and 8(*b*), the switching means 9 is composed of the solenoids 90 (90A). The solenoids 90 (90A) are formed by winding coils around bottomed cylindrical fixed iron cores, and the solenoids 90 (90A) are mounted on a non-magnetic frame 91. A central partition wall 911 of the frame 91 forms accommodating spaces of the solenoids 90 (90A) on the left and right sides, and a cross section of a periphery of each of the accommodating spaces is formed into U-shape. The solenoids 90 (90A) are mounted in the accommodating spaces of the frame 91 in a state where bottoms of the fixed iron cores abut against a partition wall 911 of the frame 91 and openings of the fixed iron cores are directed to opposite directions and exposed from the frame 91. Diameters of the cylindrical portions of the fixed iron cores of the solenoids 90 (90A) are slightly larger than those of the slide pins 83 (83A) of the connection mechanism 8, and sizes of the solenoids 90 (90A) are set such that the slide pins 83 (83A) can be received. Return springs 92 (92A) which are torsion coil springs are provided on the bottoms of the fixed iron cores of the solenoids 90 (90A).

The switching means 9 is assembled and fitted into the grip 82 of the connection member 80 in a state where a U-shaped bottom surface of the frame 91 abuts against a plate surface of the grip 82. When the switching means 9 is fitted into the grip 82, left and right edges of the U-shaped bottom surface of the frame 91 abut against the hook-shaped locking claws 821, 822, but the frame 91 is further fitted, the hook-shaped locking claws 821, 822 bend outward to permit the U-shaped bottom surface of the frame 91 to enter, and if the left and right edges of the U-shaped bottom surface of the frame 91 pass through the hooks of the locking claws 821, 822, the locking claws 821, 822 restore and the left and right edges of the U-shaped bottom surface of the frame 91 are locked to each other by the hooks. According to this, the switching means 9 is integrally assembled into the grip 82 of the connection member 80.

In a state where the connection member 80 and the slide pins 83 (83A) into which the switching means 9 is integrally assembled at the predetermined position of the substrate 1 (standby state), axes of the slide pins 83 (83A) and center lines of the movable iron cores of the solenoids 90 (90A) match with each other. The slide pins 83 (83A) are separated from the movable iron cores of the solenoids 90 (90A). The slide pins 83 (83A) of the connection mechanism 8 form the movable iron cores of the solenoids 90 (90A), and are made of magnetic body. Therefore, if the coils of the solenoids 90 (90A) are energized and excited, the slide pins 83 (83A) as movable iron cores are attracted by the fixed iron cores of the solenoids 90 (90A), and enter the cylindrical portions (accommodating spaces), and the solenoids 90 (90A) and the slide pins 83 (83A) are integrally coupled to each other. In this case, the return springs 92 (92A) are pressed by the slide pins 83 (83A) and restoring forces are stored. If energizing of the coils of the solenoids 90 (90A) is cut and the coils are brought into non-excited state (release), the slide pins 83 (83A) are pushed out from the cylindrical portions of the fixed iron cores of the solenoids 90 (90A) by the restoring forces stored in the return springs 92 (92A) and are separated from the solenoids 90 (90A). By attracting the slide pins 83 (83A) by excitation of the solenoids 90 (90A) to connect the connection mechanism 8 and the link members 60 (60A) to each other, a driving force from the motor driving unit 7 is simultaneously transmitted into the link members 60 (60A), it becomes possible to drive the two sets of first stopper members 2, 2A and second stopper members 3, 3A in synchronization, one or the other one of the slide pins 83 (83A) is attracted by the solenoids 90 (90A) to connect one or the other one of the slide pins 83 (83A), one of or the other one of the slide pins 83 (83A) is separated by releasing the solenoids 90 (90A) and by releasing the connection of the other one of or one of the slide pins 83 (83A), the driving force from the motor driving unit 7 is separately transmitted to one or the other one of the link members 60 (60A), and it is possible to separately drive one or the other one of the two sets of first stopper members and second stopper members.

Figure 9A:
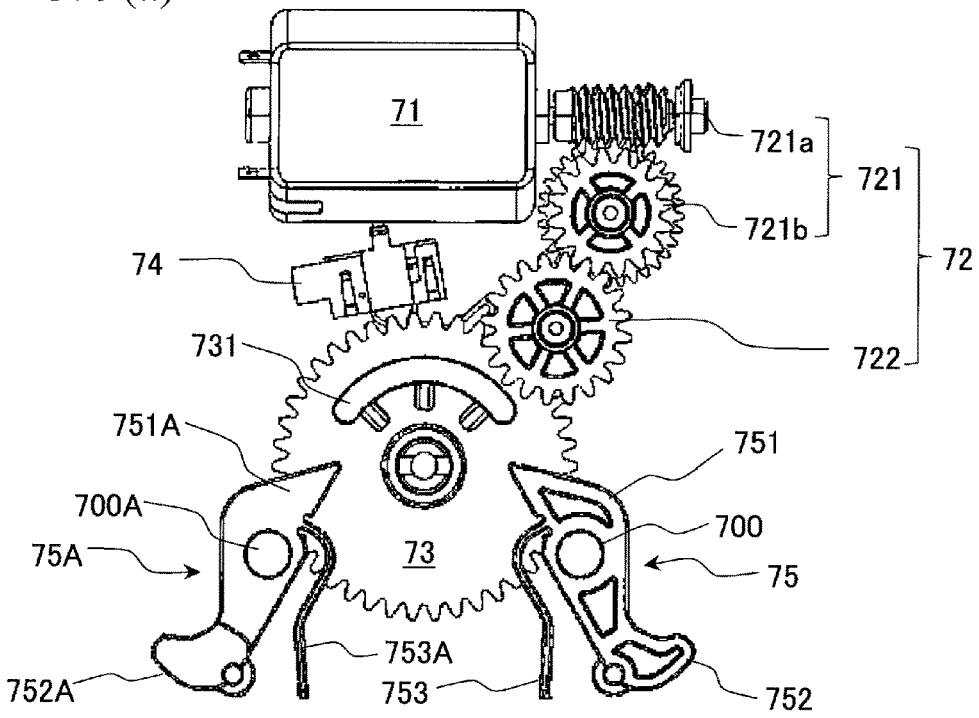
FIGS. 9(*a*) and 9(*b*) illustrate essential configurations and operations of a motor driving unit in the product carry-out device of FIG. 1, where FIG. 9(*a*) illustrates a plan view of essential portions at the time of standby and FIG. 9(*b*) illustrates a plan view of essential portions at the time of sales.
Figure 9B:
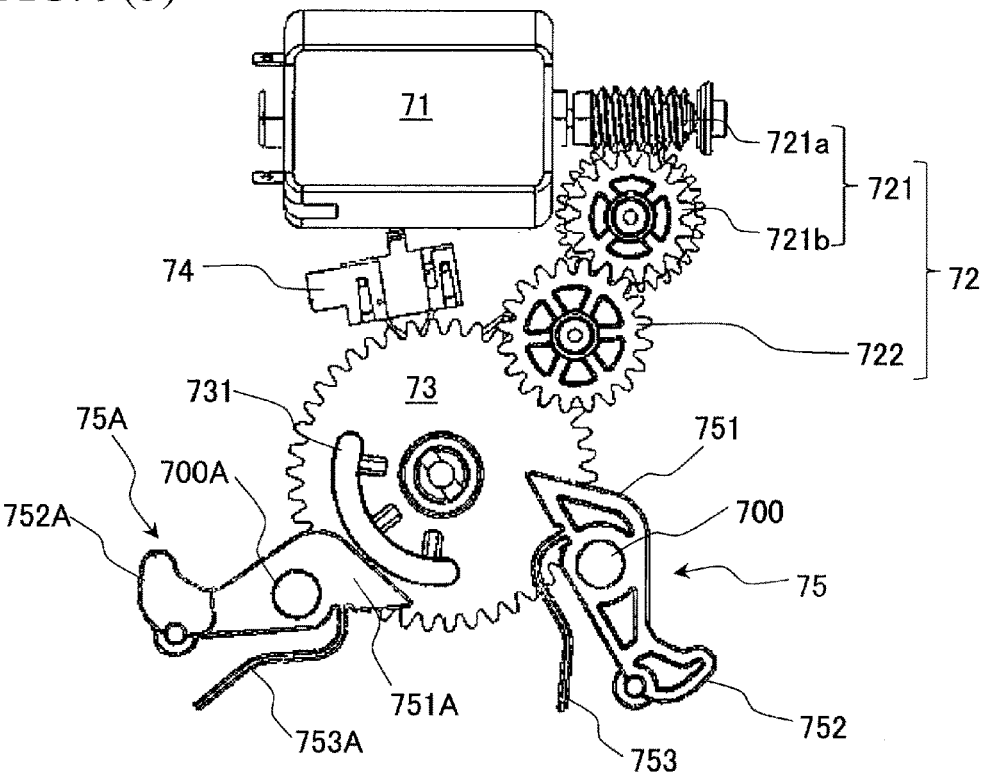

The motor driving unit 7 includes a motor 71 (see FIGS. 9(*a*) and 9(*b*)) incorporated in a unit case 70 (see FIG. 3). The motor driving unit 7 normally or reversely driven by a sales command based on operation of the product-selection button, and the link members 60 (60A) selectively rises through the link levers 75 (75A) by the rotation of the motor 71. The unit case 70 includes a base member and a cover member. The motor 71, a gear transmission mechanism 72, an output gear 73, a carrier switch 74, the link levers 75 (75A) and the like as shown in FIGS. 9(*a*) and 9(*b*) are incorporated in the unit case 70. The motor driving unit 7 is assembled into the substrate 1 by fitting a plurality of bosses (not shown) projecting from and formed on a back surface of the base member in the unit case 70 into holes if formed in a flat plate surface of the substrate 1, and a projection (not shown) provided on a side surface of the base member is locked to locking hooks 1*g* and 1*h* which are formed by cutting up the flat plate surface of the substrate 1.

The motor 71 incorporated in the unit case 70 of the motor driving unit 7 is a normally and reversely rotatable DC motor which can normally and reversely rotate in accordance with a sales command. The motor 71 is held in a base member of the unit case 70.

The gear transmission mechanism 72 includes an intermediate gear 722 and a worm gear 721 which is composed of a worm 721*a* and a worm wheel 721*b*. The worm 721*a* of the worm gear 721 is mounted on an output shaft of the motor 71. The worm wheel 721*b* is composed of a first wheel meshing with the worm 721*a* and second wheel meshing with the intermediate gear 722. These first and second wheels are different from each other in level in the vertical direction. The intermediate gear 722 is provided with a first intermediate gear meshing with the second wheel of the worm wheel 721*b*, and a second intermediate gear meshing with the output gear 73. These first and second intermediate gears are different from each other in level in the vertical direction. The worm gear 721 and the intermediate gear 722 are rotatably placed by bearing portions of the base member and the cover member of the unit case 70.

The output gear 73 is formed as a wheel which meshes with the second intermediate gear of the intermediate gear 722, a cam and a projection 731 are formed on one of plate surfaces (upper surface) of the output gear 73, and pressing piece (not shown in FIGS. 9(*a*) and 9(*b*)) which controls the carrier switch 74 is formed on the other surface (back surface) of the output gear 73. The cam and the projection 731 are formed into arc shapes, which project in a direction separating from a plate surface of the output gear 73. Arc lengths of the cam and the projection 731 are set to sufficient length so that after the link members 60 (60A) rise, its state is held for predetermined time. The pressing piece which controls the carrier switch 74 is formed into a substantially V-shape such that the pressing piece is located on the plate surface on the opposite side of the cam and the projection 731, and the pressing piece projects in a direction separating from the plate surface. The pressing piece presses a contact of the carrier switch 74 in a state of FIG. 9(*a*). The output gear 73 is rotatably placed by the bearing portions of the base member and the cover member of the unit case 70.

The carrier switch 74 is a so-called push-button, and includes a contract (not shown). The carrier switch 74 is placed slightly higher than the output gear 73 in a state where the carrier switch 74 is held by the base member of the unit case 70. If the contact of the carrier switch 74 is pressed by the pressing piece of the output gear 73, the carrier switch 74 is turned ON, and if the pressing piece of the output gear 73 is not pressed, the carrier switch 74 is turned OFF. The carrier switch 74 controls the motor 71 driven by the sales command such that the output gear 73 makes one rotation.

The link levers 75 (75A) are resin-molded articles, and are rotatably pivotally supported by lever shafts 700 (700A) provided in the cover member of the unit case 70 which penetrates base portions 751 (751A). Tip ends 752 (752A) of the link levers 75 (75A) are formed into hook shapes which curve upward in such a manner that the tip ends 752 (752A) project outward from openings (not shown) formed by notching the base member and the cover member of the unit case 70. Locking pieces 753 (753A) provided on the base portions 751 (751A) of the link levers 75 (75A) are plate-shaped resilient members which can resiliently deform. The locking pieces 753 (753A) extend rearward from rear sides of the base portions 751 (751A). Free ends of the locking pieces 753 (753A) abut against the projecting piece (not shown) provided on the cover member, thereby determining standby attitudes of the link levers 75 (75A) in the normal state at a position shown in FIG. 9(*a*)

The product carry-out device having the motor driving unit 7 of the above-described configuration is filed by the present application as Japanese Patent Application No. 2013-236105 (JP 2015-95235 A).

Sold-out detecting switches 18 (18A) are composed of microswitches which are locked and fixed to the wiring cover WC (see FIGS. 2 and 3) mounted on the substrate 1. The sold-out detecting switches 18 (18A) are placed such that contacts of the microswitches abut against the sold-out detecting pieces 26 (26A) provided on the first stopper members 2 (2A), and the sold-out detecting switches 18 (18A) detect a state that the first stopper members 2 (2A) project toward the product accommodating passage 183 at the maximum opening degree. That is, the first stopper members 2(2A) are always biased toward the projecting position by resilient biasing forces of the torsion coil springs 30 (30A), the opening degree of the first stopper members 2, 2A projecting toward the product accommodating passage 183 in a state it does not hold a product becomes maximum, and if the product drops onto the first stopper members 2, 2A which project at the maximum opening degree, the first stopper members 2, 2A slightly turn in a direction retreating from the product accommodating passage 183, tip ends of the locking projections 23 (23A) in the bearing portions 22 (22A) of the first stopper members 2 (2A) abut against the lower link pins 4, 4A which are lowered, the first stopper members 2, 2A are locked at the projecting positions projecting toward the product accommodating passage 183, and the opening degree of the first stopper members 2, 2A in the locked state becomes smaller than the maximum opening degree. When the first stopper members 2, 2A project to the maximum opening degree, the sold-out detecting pieces 26 (26A) provided on the first stopper members 2, 2A abut against contacts of the microswitches, a product drops onto the first stopper members 2, 2A which project to the maximum opening degree, and until the first stopper members 2, 2A are locked after the first stopper members 2, 2A slightly turn in a direction retreating from the product accommodating passage 183, the sold-out detecting pieces 26 (26A) provided on the first stopper members 2, 2A separate from the contracts of the microswitches, and the sold-out detecting switches 18 (18A) are turned OFF. When ON signals from the sold-out detecting switches 18 (18A) continue for predetermined time, a controller which processes signals from the sold-out detecting switches 18 (18A) determines that the products are "sold out".

The wiring cover WC is made of synthetic resin, the wiring cover WC locks the sold-out detecting switches 18 (18A), the wiring cover WC is deviated toward one of sides in the lateral direction (left side in FIG. 2) of the substrate 1, and the wiring cover WC protects wires of the motor 71 of the motor driving unit 7, the carrier switch 74, the solenoids 90 (90A) and the sold-out detecting switches 18 (18A). A holder 19 (see FIG. 2) locked to the lower flange 1*d* of the substrate 1 is integrally formed on the wiring cover WC. This holder 19 is known as one having a hook 19*a* which is engaged with a lower pin member P (see FIG. 10) provided on the product accommodating rack 180.

Figure 10:
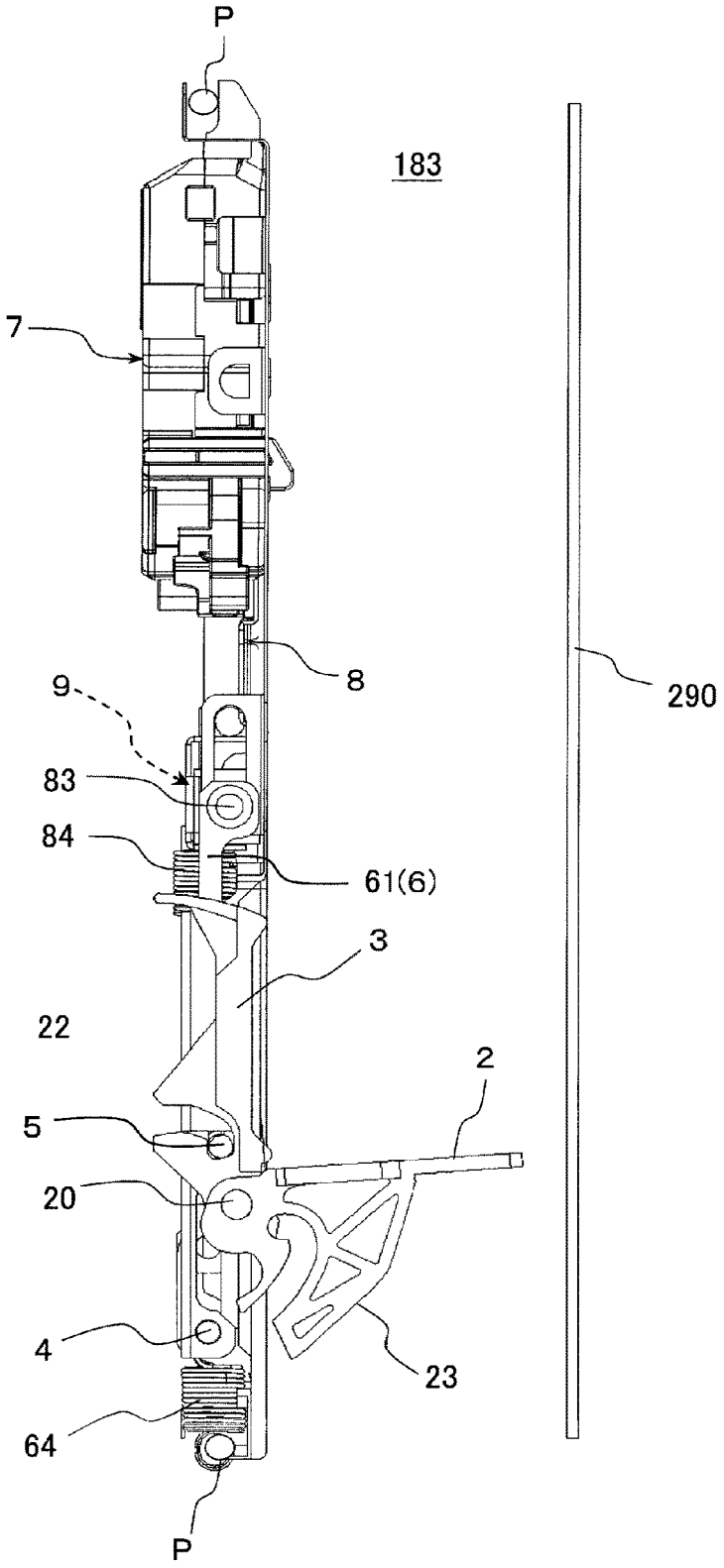
FIG. 10 illustrates a state before product loading of the product carry-out device of the automatic dispenser according to the present invention.
Figure 11:
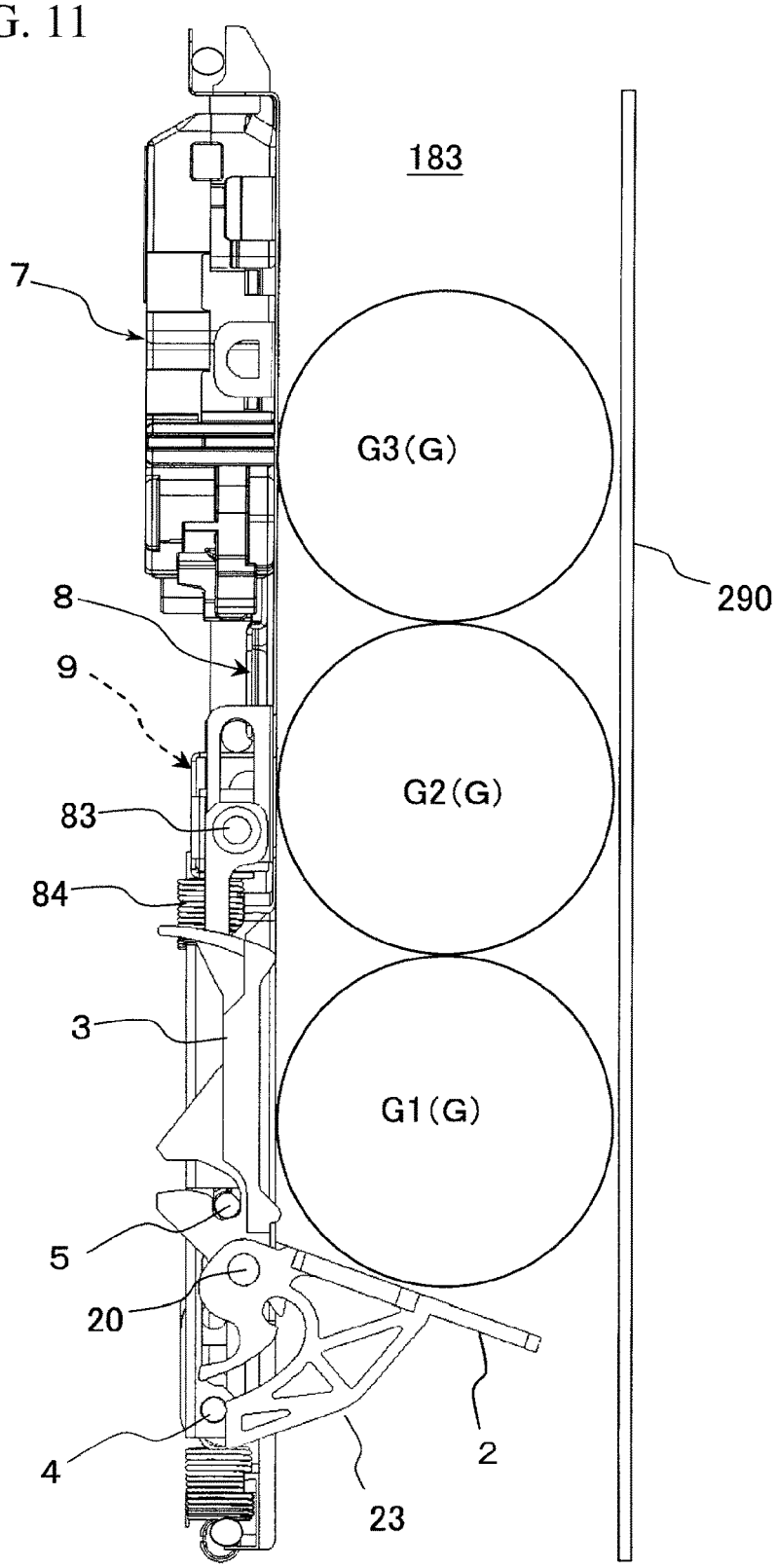
FIG. 11 illustrates an explanatory diagram of operation showing a sales standby state of the product carry-out device of the automatic dispenser according to the present invention.
Figure 12:
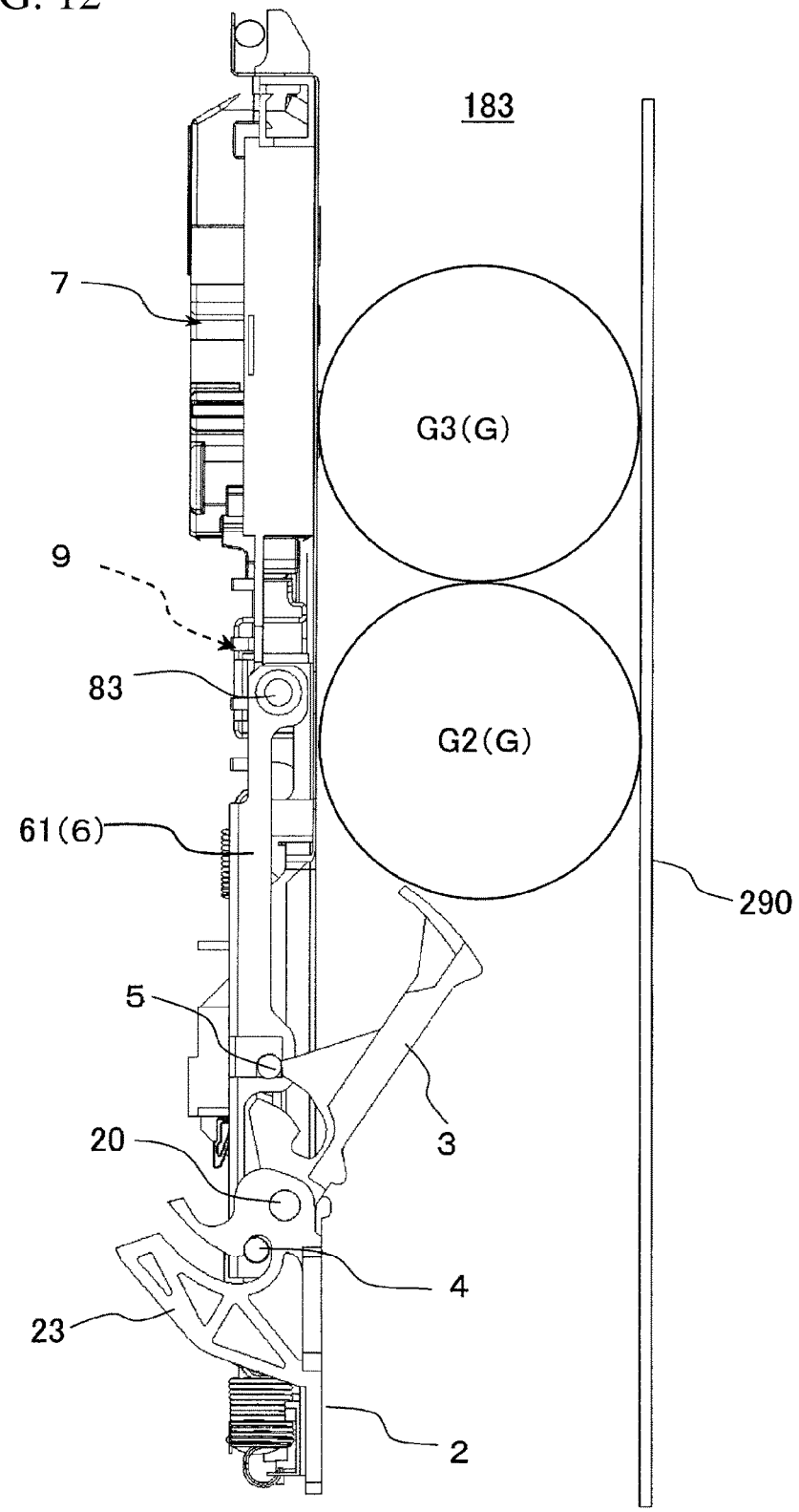
FIG. 12 illustrates an explanatory diagram of operation when a product is carried out of the product carry-out device of the automatic dispenser according to the present invention.

Operation of the product carry-out device 10 of an automatic dispenser having the above-described configuration will be described based on FIGS. 10 to 12. FIG. 10 illustrates a side sectional view of the product carry-out device before products are loaded, FIG. 11 illustrates an explanatory diagram of operation showing a sales standby state of the product carry-out device after products are loaded, and FIG. 12 illustrates an explanatory diagram of operation when a product is carried out of the product carry-out device. In the following description, long-size products are to be sold, and shows operation when the solenoids 90 (90A) of the switching means 9 excited to attract the slide pins 83 (83A), the connection mechanism 8 and the link members 60 (60A) are connected to each other by excitation, and the two sets of first stopper members 2 (2A) and second stopper members 3 (3A) are driven in synchronization. A reference sign 290 represents the outlet adjusting plates 290 which are opposed to each other to sandwich product carry-out devices 2 (2A) and the product accommodating passage 183.

As shown in FIG. 10, in the product carry-out device 10, before products are loaded, the first stopper members 2 (2A) project toward the product accommodating passage 183, and the second stopper members 3 (3A) are retreated from the product accommodating passage 183. In this case, a cam projection 731 of the output gear 73 of the motor driving unit 7 is located at the highest position (see FIG. 9(*a*)). The pressing piece for the carrier switch 74 provided on a back surface of the output gear 73 is located at the highest position, and the carrier switch 74 is in the ON state. According to this, the motor 71 is in the stopped state, and the tip ends 752 (752A) of the link levers 75 (75A) are in positions downwardly separated from the locking portions 61 (61A) of the link members 60 (60A). Hence, the link members 60 (60A) are lowered by biasing forces of the return springs 64 (64A). The first stopper members 2 (2A) is in the projecting positions where the first stopper members 2 (2A) open toward the product accommodating passage 183 at the maximum opening degree by biasing forces of the torsion coil springs 30 (30A). The lower link pins 4 (4A) which are supported by the lowered link members 60 (60A) are located on turning loci of the tip ends of the locking projections 23 (23A) of the first stopper members 2 (2A). In the state where the first stopper members 2 (2A) open at the maximum opening degree, the sold-out detecting switches 18 (18A) are ON state. The second stopper members 3 (3A) receive the lower link pins 4 (4A) supported by the lowered link members 60 (60A) in the recessed sliding grooves 321 (321A) of the second stopper members 3 (3A), and the second stopper members 3 (3A) are retreated to the retreating position.

In such a standby state, a first loaded product drops onto the first stopper members 2 (2A) which open to the maximum opening degree and located at the projecting position. By the drop of the product, the first stopper members 2 (2A) slightly turn toward the retreating position. If the tip ends of the locking projections 23 (23A) of the first stopper members 2 (2A) abut against the lower link pins 4 (4A) by this turning motion, the first stopper members 2 (2A) hold the product and are locked in a state projecting toward the product accommodating passage 183 at an opening degree smaller than the maximum opening degree, and the product held by the first stopper members 2, 2A becomes a first sales-order product (sales product G1). If the first stopper members 2, 2A are locked in the state projecting toward the product accommodating passages 183 (183A) at the opening degree smaller than the maximum opening degree in this manner, the sold-out detecting pieces 26 (26A) provided on the first stopper members 2, 2A separate from the contacts of the microswitches of the sold-out detecting switches 18 (18A), and the sold-out detecting switches 18 (18A) are brought into the OFF state. A product, which is loaded next, is stacked on the sales product G1 held by the first stopper members 2, 2A, and becomes a next sales product G2. Products (G3) loaded subsequently are stacked on the next sales product G2 sequentially (see FIG. 11).

When a sales command based on operation of the product-selection button is given, the motor 71 incorporated in the motor driving unit 7 is normally driven, and the output gear 73 rotates in a clockwise direction in FIGS. 9(*a*) and 9(*b*) through the gear transmission mechanism 72. If the output gear 73 rotates in a counterclockwise direction, the pressing piece provided on the back surface of the output gear 73 separates from the contact of the carrier switch 74, the carrier switch 74 is brought into the OFF state, and the motor 71 is normally driven until the carrier switch 74 is brought into the ON state next (i.e., until the output gear 73 makes one rotation). If the cam projection 731 abuts against the base end 751 of the link lever 75 by the rotation of the output gear 73 in the clockwise direction, the link lever 75 rotates in the counterclockwise direction in FIGS. 9(*a*), 9(*b*). By the rotation of the link lever 75 in the counterclockwise direction, its tip end 752 abuts against the engaging piece 81 of the connection member 80 which forms the connection mechanism 8, and the connection member 80 slides upward. In this case, the slide pins 83 (83A) of the connection mechanism 8 are attracted by excitation of the solenoids 90 (90A) which form the switching means 9, and the connection member 80 and the slide pins 83 (83A) are integrally coupled to each other. Therefore, the connection member 80 and the link members 60 (60A) are connected to each other through the slide pins 83 (83A). Hence, if the connection member 80 slides upward, the link members 60 (60A) rise against the biasing forces of the return springs 64 (64A). While the cam projection 731 is in sliding contact with the base end 461*a* of the link lever 75, the link members 60 (60A) are maintained in their rising states.

As the link members 60 (60A) rise, the lower link pins 4, 4A coupled to the link members 60 (60A) also rise, and a locked state of the first stopper members 2, 2A which are locked at the projecting position toward the product accommodating passage 183 is released by the lower link pins 4, 4A. According to this, the first stopper members 2, 2A receive a load of the product and start moving toward the retreating position from the product accommodating passage 183. If the first stopper members 2, 2A move to the retreating position retreating from the product accommodating passage 183, the sales product G1 passes through the first stopper members 2, 2A and is carried out downward. If the sales product G1 passes through the first stopper members 2, 2A, the first stopper members 2, 2A start moving toward the projecting position by the biasing forces of the torsion coil springs 30 (30A) and then, the first stopper members 2, 2A return to the projecting position which projects toward the product accommodating passage 183 in a state where the first stopper members 2, 2A open at the maximum opening degree.

As the link members 60 (60A) rise, the upper link pins 5, 5A received in the recessed sliding groove 321 (321A) in the second stopper members 3, 3A also rise at the same time with the lower link pins 4, 4A. According to this, the second stopper members 3, 3A are pushed out toward the projecting position, which projects toward the product accommodating passage 183 from the standby position. If the upper link pins 5, 5A rise to a position opposed to the stopper surfaces 322 (322A) formed on the stopper walls 32 (32A) of the second stopper members 3, 3A, the upper link pins 5, 5A abut against the stopper surfaces 322 (322A), and the upper link pins 5, 5A are restrained from moving to the retreating position retreating from the product accommodating passage 183 of the second stopper members 3, 3A. The second stopper members 3, 3A which move to the projecting positions projecting toward the product accommodating passage 183 abut against a lower portion of the next sales product G2 which moves downward by carrying out the sales product G1 and hold the next sales product G2, and restrain the next sales product G2 from moving downward.

The locked states of the first stopper members 2, 2A by the lower link pins 4, 4A are released by rising the link members 60 (60A), thereby permitting the first stopper members 2, 2A to move to the retreating position and carrying out the sales product G1, and the second stopper members 3, 3A are moved to the projecting positions from the retreating position to hold the next sales product G2. This operation is executed during predetermined time during which the cam projection 731 of the output gear 73 is in slide contact with the base end 751 of the link lever 75.

If the abutment between the cam projection 731 and the base end 751 of the link lever 75 is released by rotation of the output gear 73, the link members 60 (60A) come down by the biasing forces of the return springs 64 (64A). As the link members 60 (60A) come down, the upper link pins 5, 5A and the lower link pins 4, 4A supported by the link members 60 (60A) come down. If the upper link pins 5, 5A which abut against the stopper surfaces 322 (322A) in the second stopper members 3, 3A come down, the second stopper members 3, 3A are pressed by the next sales product G2 and move toward the retreating position retreating from the product accommodating passage 183. By the movement of the second stopper members 3, 3A toward the retreating position, the next sales product G2 held by the second stopper members 3, 3A starts moving downward. The lower link pins 4, 4A come down to a position intersecting with the turning loci of the tip ends of the locking projections 23 (23A) of the first stopper members 2, 2A which return to the projecting positions, and stand by. Thereafter, if the next sales product G2 drops onto the first stopper members 2, 2A which open at the maximum opening degree, the first stopper members 2, 2A move toward the retreating position, and if the arc locking projections 23 (23A) of the first stopper members 2, 2A abut against the lowered lower link pins 4, 4A, the first stopper members 2, 2A are locked at the projecting positions in a state where the next sales product G2 is held as a sales product. Thereafter, if the cam projection 731 returns to the position of the standby state by the rotation of the output gear 73, the contact of the carrier switch 74 is pressed by the pressing piece, and the carrier switch 74 is brought into ON state. According to this, the driving operation of the motor 71 is stopped, and the motor 71 returns to the standby state.

After the abutment between the cam projection 731 and the base end 751 of the link lever 75 is released by the clockwise rotation of the output gear 73, and before the cam projection 731 of the output gear 73 returns to the standby state position, the cam projection 731 abuts against the base end 751A of the link lever 75A, but the locking piece 753A made of resilient member resiliently deforms to permit the link lever 75A to turn, and the cam projection 731 returns to the returning position such that the movement of the cam projection 731 is not hindered. The cam projection 731 passes through, and the link lever 75A returns to the standby attitude shown in FIG. 9(*a*) by the action of the locking piece 753A.

The operation of the product carry-out device 10 when the long-size products are to be sold is described above, but when half-size products are to be sold, the two solenoids 90 (90A) in the switching means 9 are selectively excited and demagnetized. When the first carry-out mechanism in the product carry-out device 10 (carry-out mechanism composed of sets of first stopper member 2, second stopper member 3, and link mechanism 6 supporting lower link pin 4 and upper link pin 5) is driven to sell half-size products, the solenoid (solenoid 90) corresponding to the first carry-out mechanism of the two solenoids 90 (90A) in the switching means 9 is excited, and the other solenoid (solenoid 90A) corresponding the second carry-out mechanism (carry-out mechanism composed of sets of first stopper member 2A, second stopper member 3A, and link mechanism 6A supporting lower link pin 4A and upper link pin 5A) is brought into the demagnetized state. If the solenoid 90 corresponding to the first carry-out mechanism is excited, the slide pin 83 is attracted, and the solenoid 90 and the slide pin 83 are pulled in and integrally coupled to each other in the accommodating space of the fixed iron cores of the solenoid 90 while compressing the return spring 92. According to this, the connection member 80 of the connection mechanism 8 and the slide pin 83 are connected to each other, the link mechanism 6 of the first carry-out mechanism and the connection member 80 are connected to each other, and a driving force of the motor driving unit 7 is transmitted. On the other hand, since the solenoid 9A corresponding to the second carry-out mechanism is in the demagnetized state, the slide pin 83A separates from the fixed iron core of the solenoid 9A, and is separated from the connection member 80. According to this, the link mechanism 6A of the second carry-out mechanism is separated from the connection member 80, and a driving force from the motor driving unit 7 is not transmitted. Hence, if the motor driving unit 7 is driven, the first carry-out mechanism is drive in the similar manner to the above-described sales operation, and half-size products are carried out. Thereafter, if the cam projection 731 returns to the standby state position by rotation of the output gear 73 of the motor driving unit 7, the contact of the carrier switch 74 is pressed by the pressing piece, and when the carrier switch 74 is turned ON, energizing to the switching means 9 is cut off and the carrier switch 74 is demagnetized. According to this, the slide pin 83A which is pulled into the accommodating space of the fixed iron cores of the switching means 9 slides such that the slide pin 83A is pushed out by the return spring 92A, the slide pin 83A is separated from the connection member 80 and returns to the standby state. When the second carry-out mechanism is driven to carryout half-size products, the solenoid 9A corresponding to the second carry-out mechanism is excited, and the solenoid 9 corresponding to the first carry-out mechanism is demagnetized.

Figure 13:
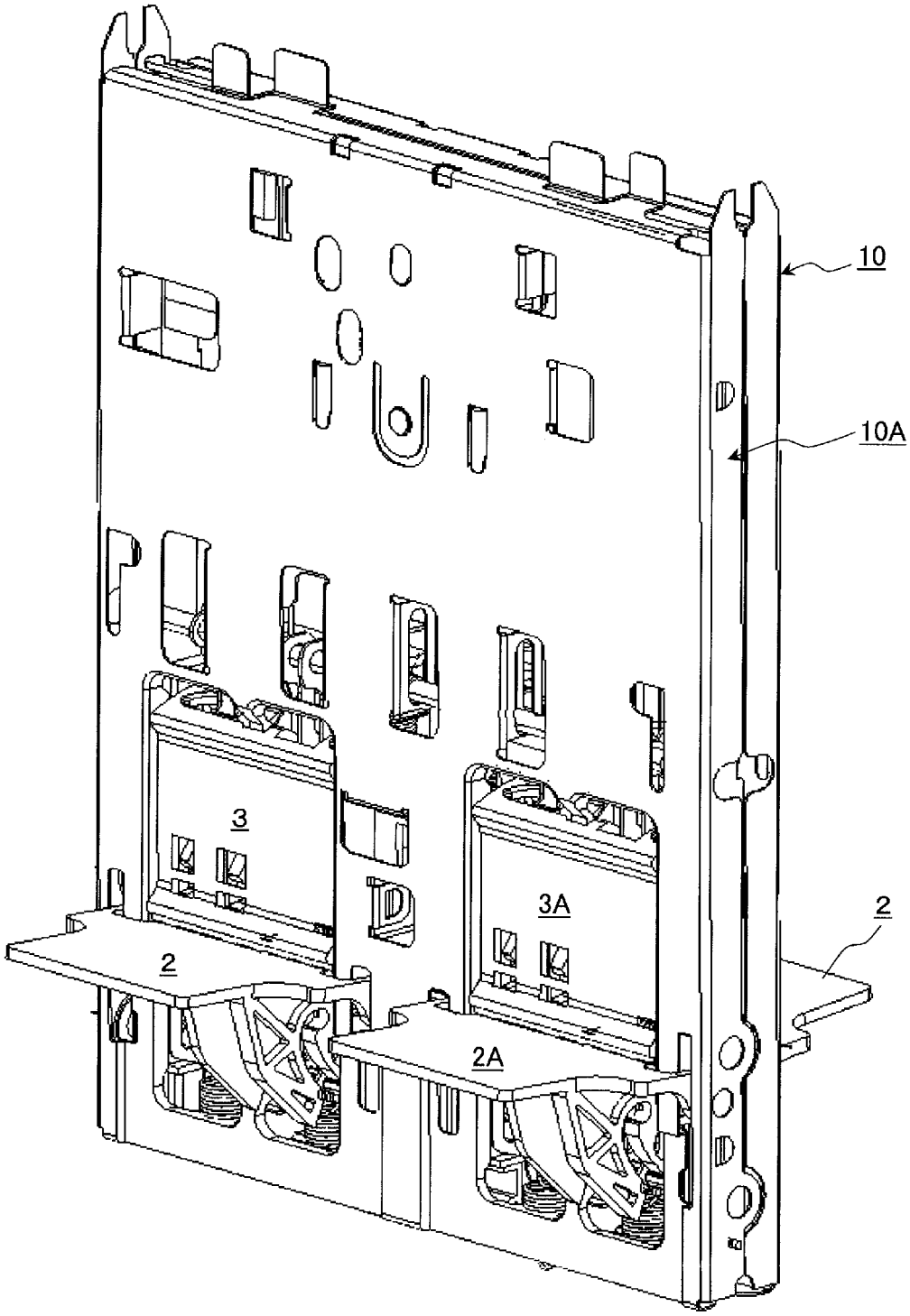
FIG. 13 illustrates a perspective view showing another product carry-out device bundled with the product carry-out device of FIGS. 1 and 2 in a back to back manner.

FIG. 13 illustrates a perspective view showing that the product carry-out device 10 shown in FIGS. 1 to 9(*b*) and another product carry-out device bundled with each other in a back to back manner. In FIG. 13, the same reference signs are allocated to the same members as those shown in FIGS. 1 to 9(*b*), and explanation thereof will be omitted.

Figure 14:
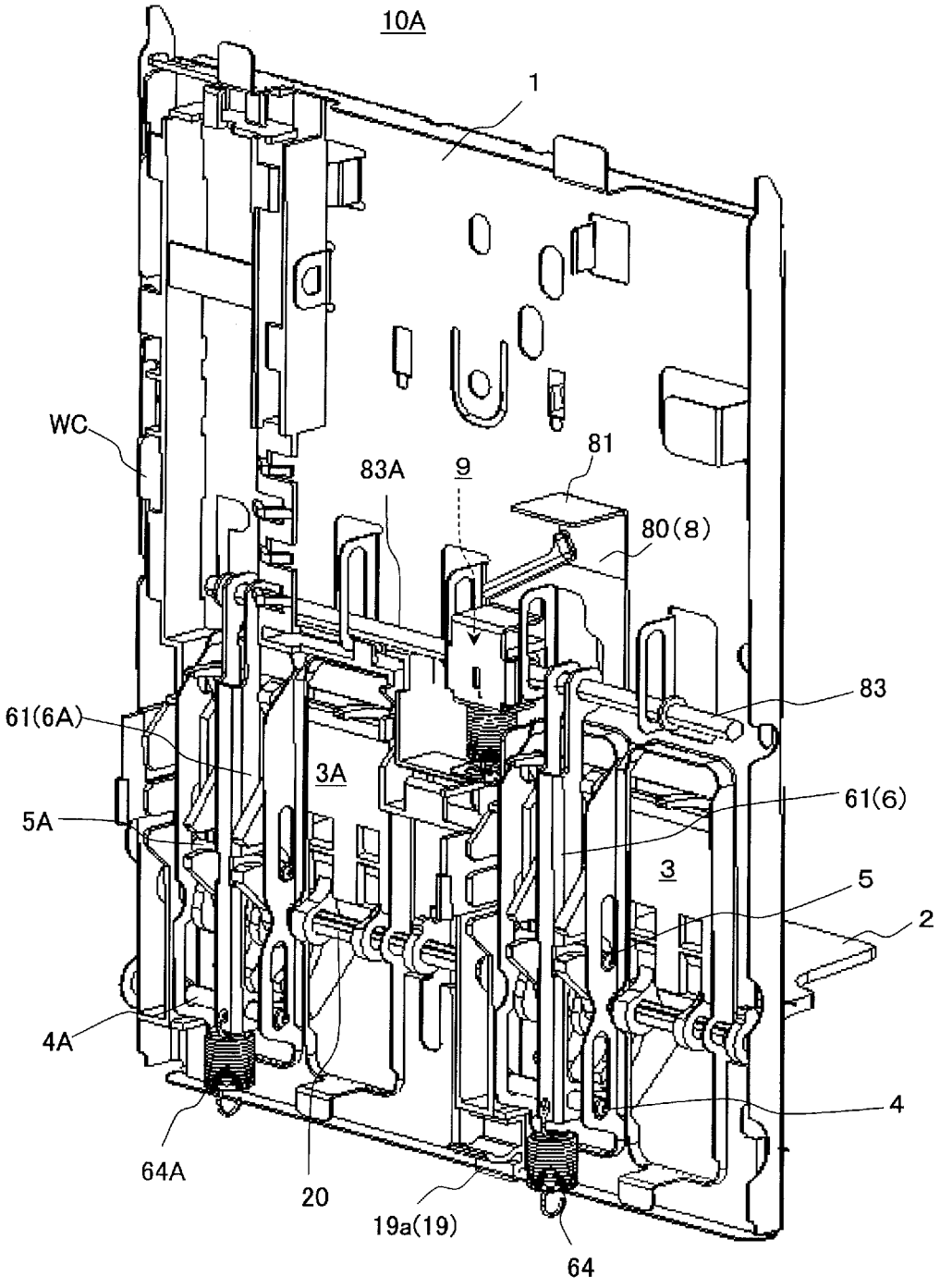
FIG. 14 illustrates a back perspective view of the other product carry-out device of FIG. 13.
Figure 15:
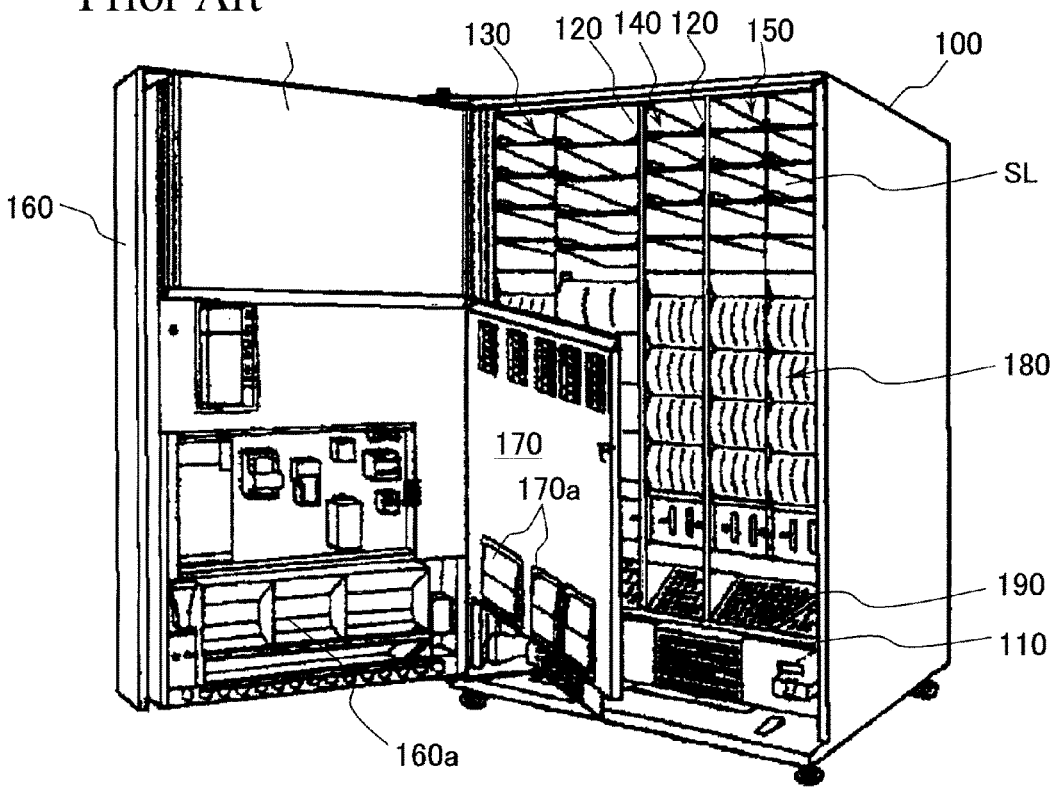
FIG. 15 Prior Art
FIG. 15 illustrates an outer door opened state of an automatic dispenser provided with the product carry-out device to which the present invention is applied.

In FIG. 13, the reference sign 10 shows the product carry-out device, and a reference sign 10A shows a product carry-out device used such that it is bundled with the former product carry-out device 10 in the back to back manner. Here, constituent members of the product carry-out device 10A are the same as those except that the motor driving unit 7 is removed from the product carry-out device 10, and FIG. 14 illustrates a back perspective view of the product carry-out device 10A. As will be understood if the back perspective view of the product carry-out device 10A shown in FIG. 14 and the back perspective view of the product carry-out device 10 shown in FIG. 2 with each other, the constituent members of the product carry-out device 10A are the same as those except that the motor driving unit 7 is removed from the product carry-out device 10, two bearing portions 22 (22A) of the first stopper members 2, 2A, and the two stopper walls 32 (32A) of the second stopper members 3, 3A are deviated to both sides in the lateral direction. According to this, even when the product carry-out device 10 and the product carry-out device 10A are bundled with each other in a back to back manner, the two bearing portions 22 (22A) of the first stopper members 2, 2A and the two stopper walls 32 (32A) of the second stopper members 3, 3A do not interfere with each other. The arc locking projections 23 (23A) projecting from the base ends of the two bearing portions 22 (22A) of the first stopper members 2, 2A project, and project toward the back surface of the substrate 1 when products are carried out, but since the locking projections 23 (23A) project into vacant regions of the openings 11 (11A) of the mutual substrates 1, projection of the locking projections 23 (23A) is not hindered. A locking piece 81 of the connection member 80 forming the connection mechanism 8 of the product carry-out device 10A is engaged with the link lever 75A (see FIG. 9) of the motor driving unit 7 of the product carry-out device 10, and by reversely driving the motor 71 of the motor driving unit 7, the first carry-out mechanism and the second carry-out mechanism are simultaneously or individually driven by action of the first carry-out mechanism of the product carry-out device 10A and the switching means 9 of the second carry-out mechanism.

As described above, the product carry-out device of an automatic dispenser according to the embodiment of the present invention is placed near an outlet of a product accommodating passage 183 which accommodates long-size products in one row in a sideways attitude, and accommodates half-size products in two rows in a longitudinal direction in sideways, in which the product carry-out device includes two sets of first stopper members 2, 2A and second stopper members 3, 3A which are provided in correspondence with half-size products arranged and accommodated in two rows, the first stopper members 2, 2A and the second stopper members 3, 3A appear in a product accommodating passage 183 and hold and open the products, and when the long-size products are to be sold, the two sets of first stopper members 2, 2A and second stopper members 3, 3A are driven in synchronization to carry out the long-size products accommodated in the product accommodating passage 183, and when the half-size products are to be sold, the two sets of first stopper members 2, 2A and second stopper members 3, 3A are individually driven to carry out the half-size products accommodated in the product accommodating passage 183, wherein the product carry-out device 10 includes a single driving means (motor driving unit 7) for driving the two sets of first stopper members 2, 2A and second stopper members 3, 3A, a link mechanism 6, 6A having two sets of link members 60 (60A) provided in correspondence with the two sets of first stopper members 2, 2A and second stopper members 3, 3A and supporting lower link pins 4, 4A and upper link pins 5, 5A for moving the two sets of first stopper members 2, 2A and second stopper members 3, 3A to a projecting position and a retreating position, a connection mechanism 8 for connecting the single driving means (motor driving unit 7) and the link mechanisms 6, 6A to each other, and switching means 9 for selectively connecting and disconnecting the connection mechanism 8 and the link mechanism 6, 6A to and from each other, the two sets of first stopper members 2, 2A and second stopper members 3, 3A are driven in synchronization by connecting the connection mechanism 8 and the two sets of link members 60 (60A) of the link mechanisms 6, 6A to each other by the switching means 9, the connection mechanism 8 and one or the other of the two sets of link members 60 (60A) of the link mechanisms 6, 6A are connected to each other by the switching means 9, the connection mechanism 8 and the one or the other one of the two sets of link members 60 (60A) of the link mechanisms 6, 6A are separated from each other, thereby individually driving one or the other of the two sets of first stopper members 2, 2A and second stopper members 3, 3A. According to this, two sets of first stopper members 2, 2A and second stopper members 3, 3A which are provided in correspondence with half-size products arranged and accommodated in two rows and which appear in the product accommodating passage 183 to hold and open the products can be driven by the single driving means (motor driving unit 7). When driving means which individually drives the two sets of first stopper members and second stopper members are provided as in the conventional device, a failure rate becomes high, and if the driving means fails to operate properly, products, especially long-size products cannot be sold, but the present invention has an effect that it is possible to reduce the failure rate of the driving means, and to miss the product sales chance.

In the product carry-out device 10 of the embodiment, the connection member 80 grasps the switching means 9 and they are integrally provided on the connection mechanism 8, but the switching means 9 may be placed on the side of the other end (on the side of flanges 1*a*, 1*b* of substrate 1) of the slide pins 83 (83A) of a later-described connection mechanism 8. Therefore, the present invention is not limited to the embodiment.

REFERENCE SIGNS LIST

1 . . . substrate, 2, 2A . . . first stopper member, 3, 3A . . . second stopper member, 4, 4A . . . lower link pin, 5, 5A . . . upper link pin, 6, 6A . . . link mechanism, 7 . . . motor driving unit (driving means), 8 . . . connection mechanism, 9 . . . switching means, 10, 10A . . . product carry-out device, 20 . . . turning shaft, 60, 60A . . . link member, 71 . . . motor, 80, 80A . . . connection member, 83, 83A . . . slide pin, 90, 90A . . . solenoid

The invention claimed is:

1. A product carry-out device of the automatic dispenser for a product accommodating passage, comprising:

first and second sets of stopper members arranged side by side in a longitudinal direction of the product carry-out device adapted to separately hold a first size product accommodated in the product accommodating passage or to cooperatively hold a second size product accommodated in the product accommodating passage and having a length longer than that of the first size product in the longitudinal direction, each of the first and second sets of stopper members including a first stopper member and a second stopper member;

a first link member linking the first stopper member and the second stopper member of the first set of stopper members, and a second link member linking the first stopper member and the second stopper member of the second set of stopper members;

a connection mechanism connecting to the first and second link members to link the first and second sets of stopper members, or connecting to the first link member to link the first set of stopper members, or connecting to the second link member to link the second set of stopper members;

a switching device attached to the connection mechanism, and selectively connecting the first and second link members to the connection mechanism, or connecting the first link member to the connection mechanism, or connecting the second link member to the connection mechanism; and a single driving device connecting to the connection mechanism, and driving the first and second sets of stopper members when the switching device connects the first and second link members and the connection mechanism, or driving the first set of stopper members when the switching device connects the first link member and the connection mechanism, or driving the second set of stopper members when the switching device connects the second link member and the connection mechanism, wherein when the switching device connects the first and second link members and the connection mechanism, the first stopper members of the first and second sets of stopper members are synchronously driven to project into the product accommodating passage adapted to hold the second size product and to retract from the product accommodating passage adapted to carry the second size product out of the product accommodating passage, and the second stopper members of the first and second sets of stopper members are synchronously driven to project into the product accommodating passage adapted to hold another second size product in the product accommodating passage and to retract from the product accommodating passage adapted to carry the another second size product to the first stopper members of the first and second sets of stopper members, when the switching device connects the first link member and the connection mechanism, only the first stopper member of the first set of stopper members is driven to project into the product accommodating passage adapted to hold the first size product and to retract from the product accommodating passage adapted to carry the first size product out of the product accommodating passage, and only the second stopper member of the first set of stopper members is driven to project into the product accommodating passage adapted to hold another first size product and to retract from the product accommodating passage adapted to carry the another first size product to the first stopper member of the first set of stopper members, and when the switching device connects the second link member and the connection mechanism, only the first stopper member of the second set of stopper members is driven to project into the product accommodating passage adapted to hold the first size product and to retract from the product accommodating passage adapted to carry the first size product out of the product accommodating passage, and only the second stopper member of the second set of stopper members is driven to project into the product accommodating passage adapted to hold another first size product and to retract from the product accommodating passage adapted to carry the another first size product to the first stopper member of the second set of stopper members.

2. The product carry-out device of the automatic dispenser according to claim 1, further comprising first lower and upper link pins supported to the first link member, and second lower and upper link pins supported to the second link member, wherein the first and second lower link pins engage the first members of the first and second sets of stopper members to project or retreat the first members of the first and second sets of stopper members, and the first and second upper link pins engage the second members of the first and second sets of stopper members to project or retreat the second members of the first and second sets of stopper members.

3. A product carry-out device of the automatic dispenser for a product accommodating passage, comprising:

first and second sets of stopper members arranged side by side in a longitudinal direction of the product carry-out device adapted to separately hold a first size product accommodated in the product accommodating passage or to cooperatively hold a second size product accommodated in the product accommodating passage and having a length longer than that of the first size product in the longitudinal direction, each of the first and second sets of stopper members including a first stopper member and a second stopper member;

a first link member linking the first stopper member and the second stopper member of the first set of stopper members, and a second link member linking the first stopper member and the second stopper member of the second set of stopper members;

a connection mechanism connecting to the first and second link members to link the first and second sets of stopper members, or connecting to the first link member to link the first set of stopper members, or connecting to the second link member to link the second set of stopper members;

a switching device attached to the connection mechanism, and selectively connecting the first and second link members to the connection mechanism, or connecting the first link member to the connection mechanism, or connecting the second link member to the connection mechanism; and a single driving device connecting to the connection mechanism, and driving the first and second sets of stopper members when the switching device connects the first and second link members and the connection mechanism, or driving the first set of stopper members when the switching device connects the first link member and the connection mechanism, or driving the second set of stopper members when the switching device connects the second link member and the connection mechanism, wherein the switching device includes a frame forming an accommodating space thereinside, a partition wall partitioning the accommodating space into two spaces, and first and second solenoids stored in the two spaces;

the connection mechanism includes a connection member, a grip portion arranged at a lower portion of the connection member and gripping the switching device, a first slide pin arranged at a side of the first solenoid, and a second slide pin arranged at a side of the second solenoid, the first and second slide pins connecting the first and second link members and the first and second solenoids, connecting the first link member and the first solenoid, or connecting the second link member and the second solenoid; and when the first and second solenoids are energized and excited, the first and second slide pins and the first and second solenoids are coupled to connect the connection mechanism and the first and second link members, when the first solenoid is energized and excited, the first solenoid and the first slide pin are coupled to connect the connection mechanism and the first link member, and when the second solenoid is energized and excited, the second solenoid and the second slide pin are coupled to connect the connection mechanism and the second link member.

4. The product carry-out device of the automatic dispenser according to claim 3, wherein the connection member includes an engaging piece at an upper portion thereof, and the single driving device includes a motor, an output gear connecting the motor and having a cam projection protruding outwardly in a direction apart from the output gear, and a link lever having an upper portion to be contacted to the cam projection and a lower portion to be contacted to the engaging piece to transmit a driving force of the motor to the first and second link members or one of the first and second link members connecting the connection mechanism.

* * * * *